US011064756B2

(12) United States Patent
Kidman et al.

(10) Patent No.: US 11,064,756 B2
(45) Date of Patent: Jul. 20, 2021

(54) HEAD UNIT SYSTEM WITH CONNECTOR FOR PERIPHERAL DEVICE

(71) Applicant: Stryker Corporation, Kalamazoo, MI (US)

(72) Inventors: Beau Michael Kidman, Kalamazoo, MI (US); Brian James Vanderwoude, Portage, MI (US); Bryan Matthew Ulmer, Grand Rapids, MI (US)

(73) Assignee: Stryker Corporation, Kalamazoo, MI (US)

( * ) Notice: Subject to any disclaimer, the term of this patent is extended or adjusted under 35 U.S.C. 154(b) by 365 days.

(21) Appl. No.: 16/061,806

(22) PCT Filed: Dec. 14, 2016

(86) PCT No.: PCT/US2016/066633
§ 371 (c)(1),
(2) Date: Jun. 13, 2018

(87) PCT Pub. No.: WO2017/112485
PCT Pub. Date: Jun. 29, 2017

(65) Prior Publication Data

US 2018/0368505 A1 Dec. 27, 2018

Related U.S. Application Data

(60) Provisional application No. 62/271,004, filed on Dec. 22, 2015.

(51) Int. Cl.
*A42B 3/28* (2006.01)
*A42B 3/04* (2006.01)
(Continued)

(52) U.S. Cl.
CPC ..... *A42B 3/286* (2013.01); *A42B 3/04* (2013.01); *A42B 3/042* (2013.01); *A42B 3/044* (2013.01);
(Continued)

(58) Field of Classification Search
CPC ..... A42B 3/286; A42B 3/04; A42B 3/0406; A42B 3/042; A42B 3/044; A42B 3/145;
(Continued)

(56) References Cited

U.S. PATENT DOCUMENTS 3,302,018 A * 1/1967 Harding ..... A42B 3/044 362/106
4,521,831 A * 6/1985 Thayer ..... A42B 3/044 2/422
(Continued)

FOREIGN PATENT DOCUMENTS

EP 2399472 A1 12/2011
EP 2517757 A2 10/2012
WO 2014160149 A2 10/2014

OTHER PUBLICATIONS

BFW Inc., "7930HD Headlight Imaging System", 2015, 2 pages.
(Continued)

*Primary Examiner* — Khaled Annis
*Assistant Examiner* — Dakota Marin
(74) *Attorney, Agent, or Firm* — Howard & Howard Attorneys PLLC

(57) ABSTRACT

A head unit system (24) for a head (22) of a user (20), including a headpiece (26) for being worn over the head (22) with a support structure (28) shaped to be worn over the head (22). A shield mount (30) attached to the support structure (28) is arranged for supporting a face shield (32) adjacent to the head (22). A headpiece connector (34) is attached to the support structure (28) and has a headpiece
(Continued)

contact (36) configured for electrical connection. First and second peripheral devices are provided for being secured to the headpiece (26) for concurrent movement, and each respectively has a device connector (40) with a device contact (42) configured for electrical connection. The device connectors (40) and the headpiece connector (34) cooperate to releasably attach one of the respective peripheral devices to the headpiece (26) in a secured configuration (44) with the respective headpiece contact (36) and the device contact (42) abutting in the secured configuration (44) so as to facilitate electrical connection between the headpiece (26) and the secured peripheral device.

20 Claims, 18 Drawing Sheets

(51) Int. Cl.

| | |
|---|---|
| ***A42B 3/30*** | (2006.01) |
| ***A42B 3/14*** | (2006.01) |
| *A42B 3/18* | (2006.01) |
| *A42B 3/20* | (2006.01) |
| *A42B 3/22* | (2006.01) |

(52) U.S. Cl.
CPC ..... *A42B 3/145* (2013.01); *A42B 3/30* (2013.01); *A42B 3/0406* (2013.01); *A42B 3/18* (2013.01); *A42B 3/185* (2013.01); *A42B 3/20* (2013.01); *A42B 3/22* (2013.01)

(58) Field of Classification Search
CPC .. A42B 3/30; A42B 3/18; A42B 3/185; A42B 3/20; A42B 3/22
USPC ..... 2/424
See application file for complete search history.

(56) References Cited

U.S. PATENT DOCUMENTS

| | | | | |
|---|---|---|---|---|
| 4,893,356 | A * | 1/1990 | Waters | A42B 1/008 2/171.3 |
| 6,325,521 | B1 * | 12/2001 | Gregg | A42B 3/0433 362/106 |
| 6,456,261 | B1 * | 9/2002 | Zhang | A42B 3/042 345/7 |
| 6,862,748 | B2 * | 3/2005 | Prendergast | G02B 23/125 2/422 |
| 7,805,776 | B2 * | 10/2010 | Crossman | A42B 3/20 2/424 |
| 8,015,626 | B2 * | 9/2011 | Grassl | A62B 18/084 2/422 |
| 9,066,551 | B2 | 6/2015 | Van Waes | |
| 9,389,677 | B2 * | 7/2016 | Hobby | G06F 3/005 |
| 9,578,916 | B2 * | 2/2017 | Daniels | A42B 3/044 |
| 9,702,534 | B1 * | 7/2017 | Brion | A42B 1/244 |
| 10,470,502 | B2 * | 11/2019 | Rosati | A41D 13/0025 |
| 2002/0118532 | A1 * | 8/2002 | Gates | A42B 3/28 362/105 |
| 2002/0145865 | A1 * | 10/2002 | Gregg | A42B 3/044 362/106 |
| 2002/0159250 | A1 * | 10/2002 | Kuo | A42B 3/044 362/106 |
| 2003/0058544 | A1 * | 3/2003 | Bianco | G02B 27/0176 359/630 |
| 2005/0174753 | A1 * | 8/2005 | Cao | F21V 29/74 362/106 |
| 2006/0282939 | A1 * | 12/2006 | Rogers | A42B 3/04 2/422 |
| 2009/0126059 | A1 * | 5/2009 | Tack | A42B 3/04 2/2.5 |
| 2010/0001927 | A1 * | 1/2010 | Hough | G02B 7/002 345/8 |
| 2012/0117717 | A1 * | 5/2012 | McGinn | A42B 3/185 2/424 |
| 2012/0224356 | A1 * | 9/2012 | Fischer | A42B 3/0446 362/106 |
| 2014/0020159 | A1 | 1/2014 | Teetzel et al. | |

OTHER PUBLICATIONS

Cuda Surgical, "P/N SYN 400FS Surgical HL Camera System", 2015, http:/ww.cuda.com/sys-400fs-surgical-headlight-camera, 3 pages.
Designs for Vision Inc., "LED Daylite NanoCam", 2015, https://www.designsforvision.com/SurgHtml/S-Ncam.htm, 2 pages.
International Search Report for PCT/US2016/066633 dated Mar. 30, 2017, 3 pages.
Lazersport, "Helmets", 2016, http://www.lazersport.com, 2 pages.
Loupecam,"Surgical-Grade ProHD LoupeCam", 2015, https://www.loupecam.com/cirkuit/seo-cart-front-end/product/image . . . , 1 page.

* cited by examiner

HEAD UNIT SYSTEM WITH CONNECTOR FOR PERIPHERAL DEVICE

CROSS-REFERENCE TO RELATED APPLICATION

The subject patent application is a U.S. National Stage of International Patent Application No. PCT/US2016/066633, filed on Dec. 14, 2016, which claims priority to and all the benefits of U.S. Provisional Patent Application Ser. No. 62/271,004 which was filed on Dec. 22, 2015, the disclosure of which is hereby incorporated by reference.

TECHNICAL FIELD

The embodiments set forth herein relate, generally, to head unit systems and, more specifically, to a head unit system with a connector for a peripheral device.

BACKGROUND

Conventional head units known in the art are employed to provide personal protection to a user, such as a medical professional engaged in a surgical procedure. To that end, the head unit is mounted to the user's head for concurrent movement, and an article is removably attached to the head unit to serve as a barrier between the user and the operating environment. The article is typically realized as a transparent face shield, and may also include a disposable hood (sometimes referred to as a "gown" or "toga"). The article protects the user during medical practices and procedures by preventing contact with blood, tissue, bone fragments, and the like during execution of medical procedures, such as blood splatter dispersed by a surgical instrument.

Those having ordinary skill in the art will appreciate that the user experiences a certain level of discomfort when equipped with articles of the types described above. By way of example, the presence of the head unit and/or article can make visual observation difficult for the user where glare is created on the face shield or shadows are cast over the user's eyes. Verbal communication can similarly be complicated in that the article can muffle the user's voice and make it difficult for the user to hear. Further, where the article employs a hood, heat and $CO_2$ may be trapped and/or accumulate in the hood, thereby affecting the user's breathing and body temperature regulation.

There remains a need in the art for a head unit which can be used in different types of medical practices and procedures, and which strikes a substantial balance between usability, functionality, and manufacturing cost while, at the same time, affording improved adaptability to accommodate different types of features to improve user comfort and sensory perception.

SUMMARY

In one embodiment, a head unit system for a head of a user is provided with a headpiece for being worn over the head of the user. The headpiece includes a support structure shaped to be worn over the head of the user. A shield mount is operatively attached to the support structure and is arranged for supporting a face shield adjacent to the head of the user. A headpiece connector is operatively attached to the support structure and includes a headpiece contact configured for electrical connection. A first peripheral device is provided for being secured to the headpiece for concurrent movement therewith. The first peripheral device has a first device connector with a first device contact configured for electrical connection. A second peripheral device is provided for being secured to the headpiece for concurrent movement therewith. The second peripheral device has a second device connector with a second device contact configured for electrical connection. One of the first device connector and the second device connector are configured to cooperate with the headpiece connector to releasably attach one of the first peripheral device and the second peripheral device to the headpiece in a secured configuration with the headpiece contact and one of the first device contact and the second device contact abutting in the secured configuration so as to facilitate electrical connection between the headpiece connector and one of the first device connector and the second device connector when the respective peripheral device is secured to the headpiece.

DETAILED DESCRIPTION

Figure 1:
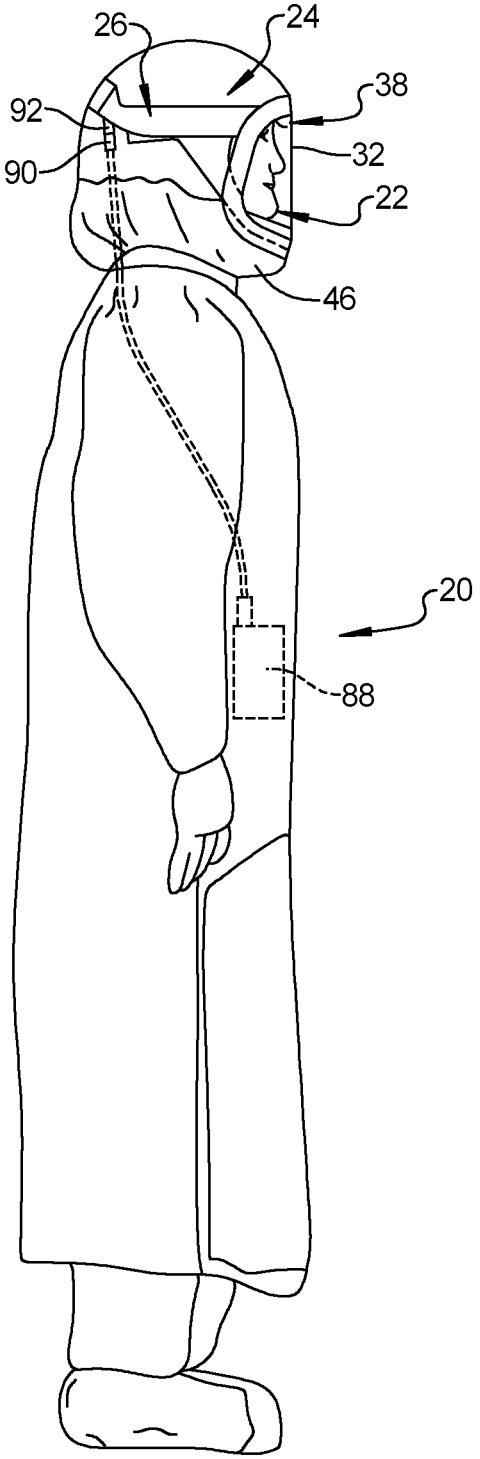
FIG. 1 is a side view of a user wearing a headpiece according to one embodiment, shown with a hood and a face shield attached.

With reference now to the drawings, wherein like numerals indicate like parts throughout the several views, a user is generally shown at 20 in FIG. 1. The user's head 22 supports a head unit system 24 which, in turn, is configured to serve as a personal protective barrier for the user 20 in one embodiment. Specifically, the head unit system 24 is adapted for use in the medical industry and serves as a personal protective barrier for the user 20 by preventing contact with blood, tissue, bone fragments, and the like which may be encountered during the execution of medical practices and procedures, such as blood splatter dispersed towards the user 20 by a surgical instrument.

Referring now to FIGS. 1-5B, the head unit system 24 includes a headpiece, generally indicated at 26, for being worn over the head 22 of the user 20. The headpiece 26 includes a support structure, generally indicated at 28, shaped to be worn over the head 22 of the user 20. A shield mount, generally indicated at 30, is operatively attached to the support structure 28 and is arranged for supporting a face shield 32 adjacent to the head 22 of the user 20, as described in greater detail below. At least one headpiece connector, generally indicated at 34, is operatively coupled to the support structure 28 of the headpiece 26 and has at least one headpiece contact 36 configured for electrical connection (see FIGS. 12 and 14). However, as is described in greater detail below, the headpiece connector 34 could be operatively coupled to any suitable part of the headpiece 26. The head unit system 24 further includes a peripheral device, generally indicated at 38, for being secured to the headpiece 26 for concurrent movement therewith. As is described in greater detail below, the head unit system 24 may include several different peripheral devices 38. Each of the peripheral devices 38 has a device connector, generally indicated at 40, with at least one device contact 42 configured for electrical connection (see FIGS. 11 and 13). As is described in greater detail below, the peripheral device 38 could be any suitable type of device adapted for releasable attachment to the headpiece 26.

Figure 2:
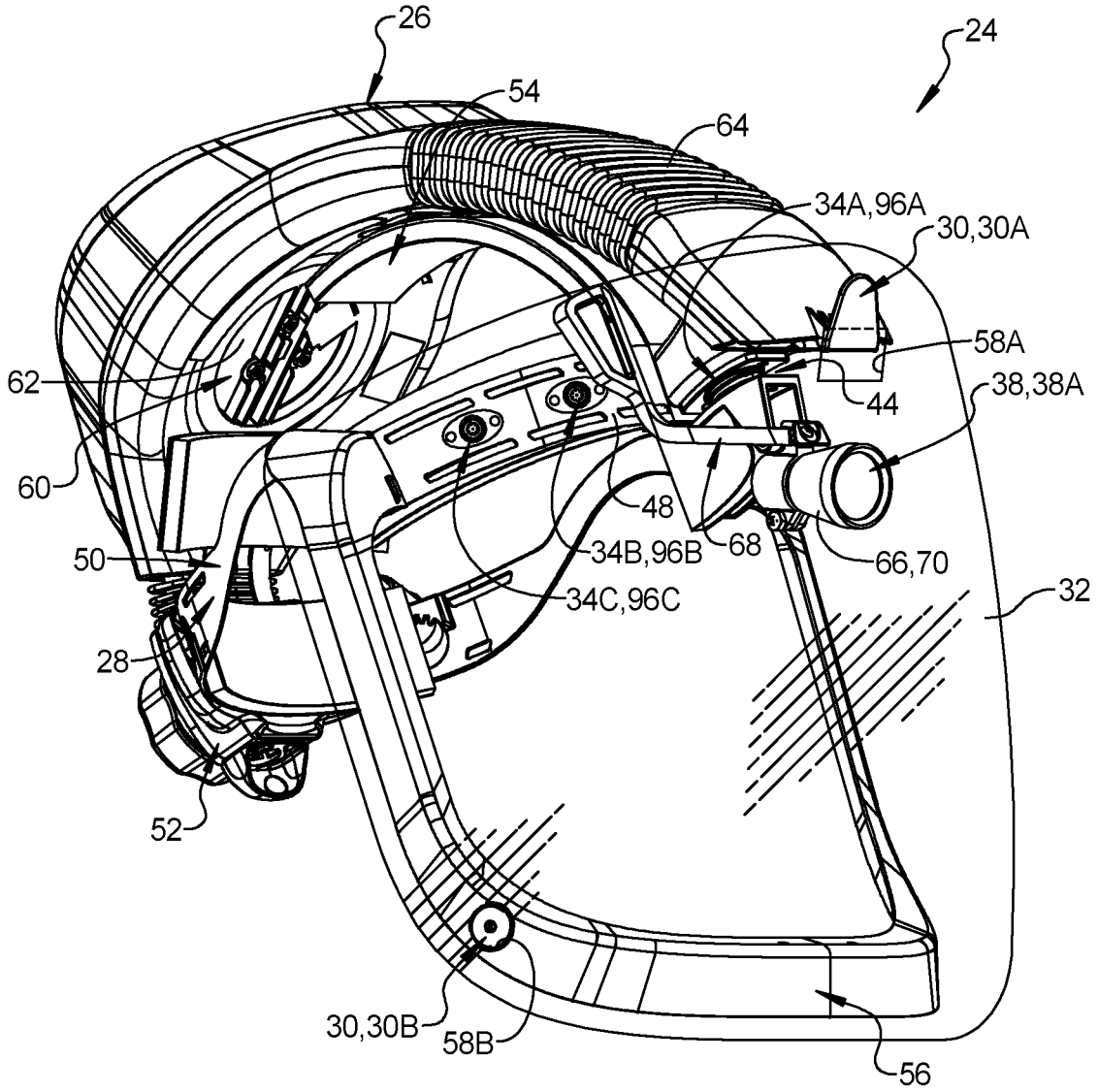
FIG. 2 is a perspective view of a head unit system according to one embodiment shown with a face shield attached to a headpiece with a peripheral device secured to the headpiece.
Figure 3:
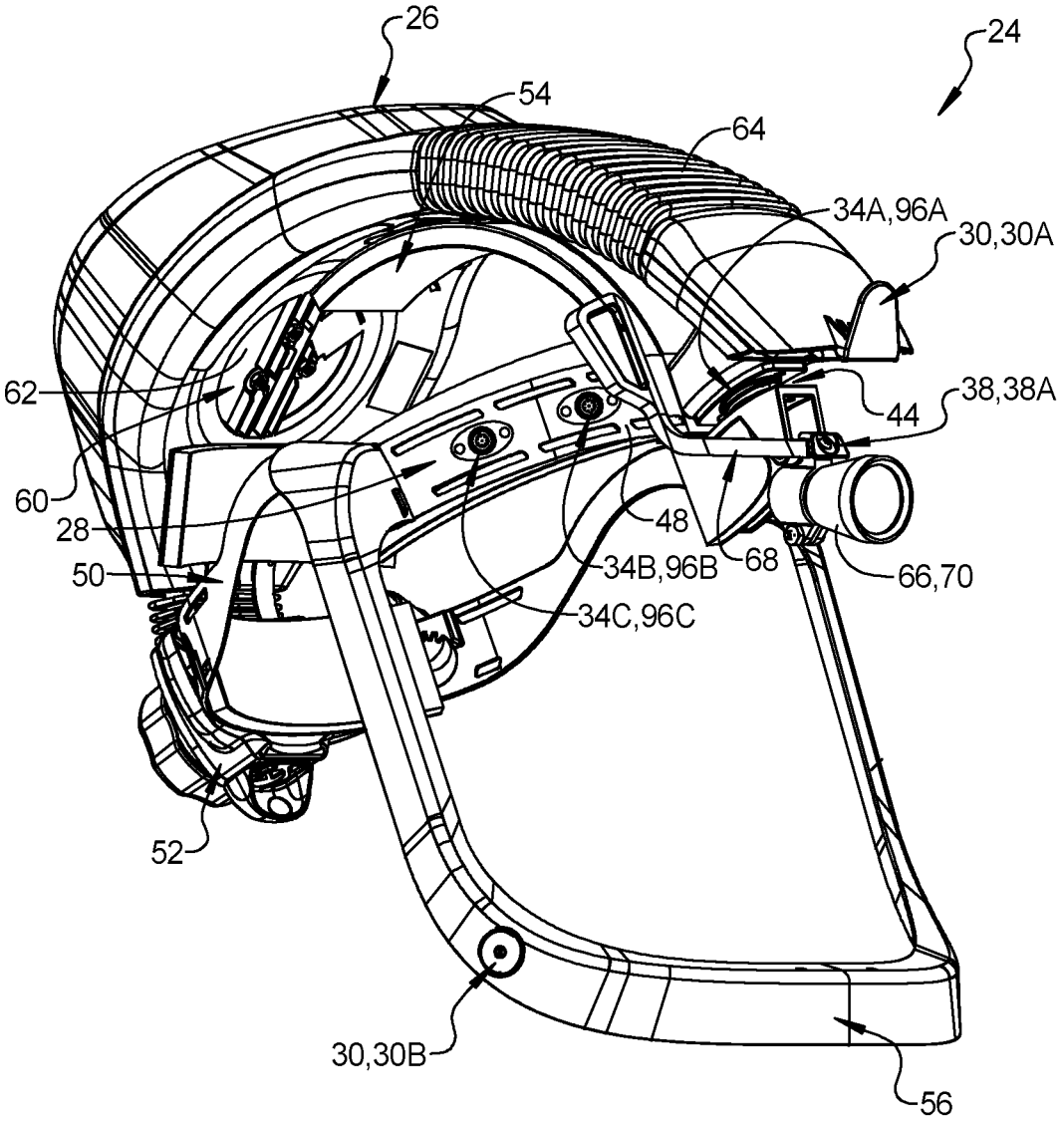
FIG. 3 is a perspective view of the head unit system of FIG. 2 shown without the face shield.
Figure 4:
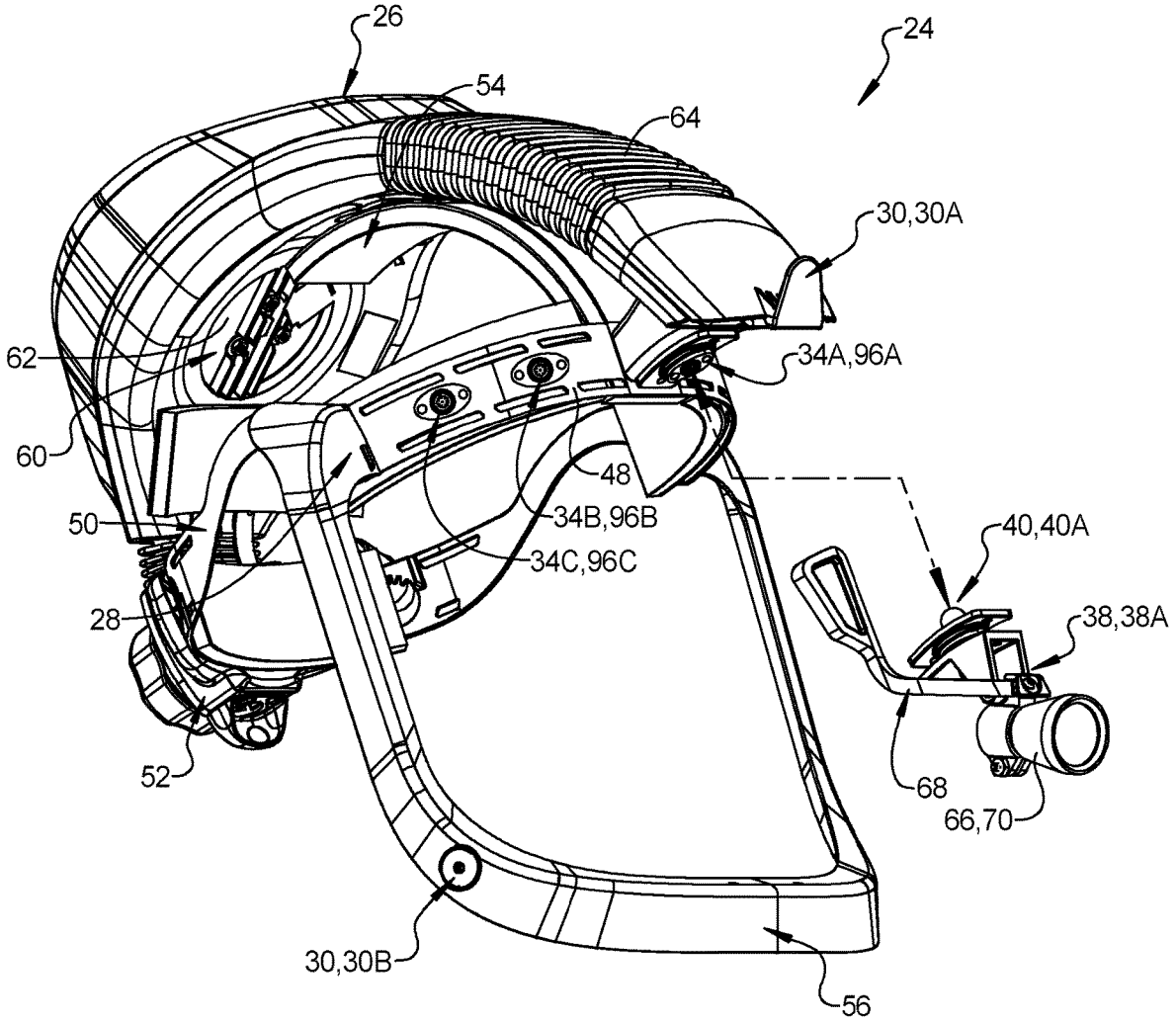
FIG. 4 is a partially exploded perspective view of the head unit system of FIGS. 2-3 shown with the peripheral device spaced from the headpiece.
Figure 5A:
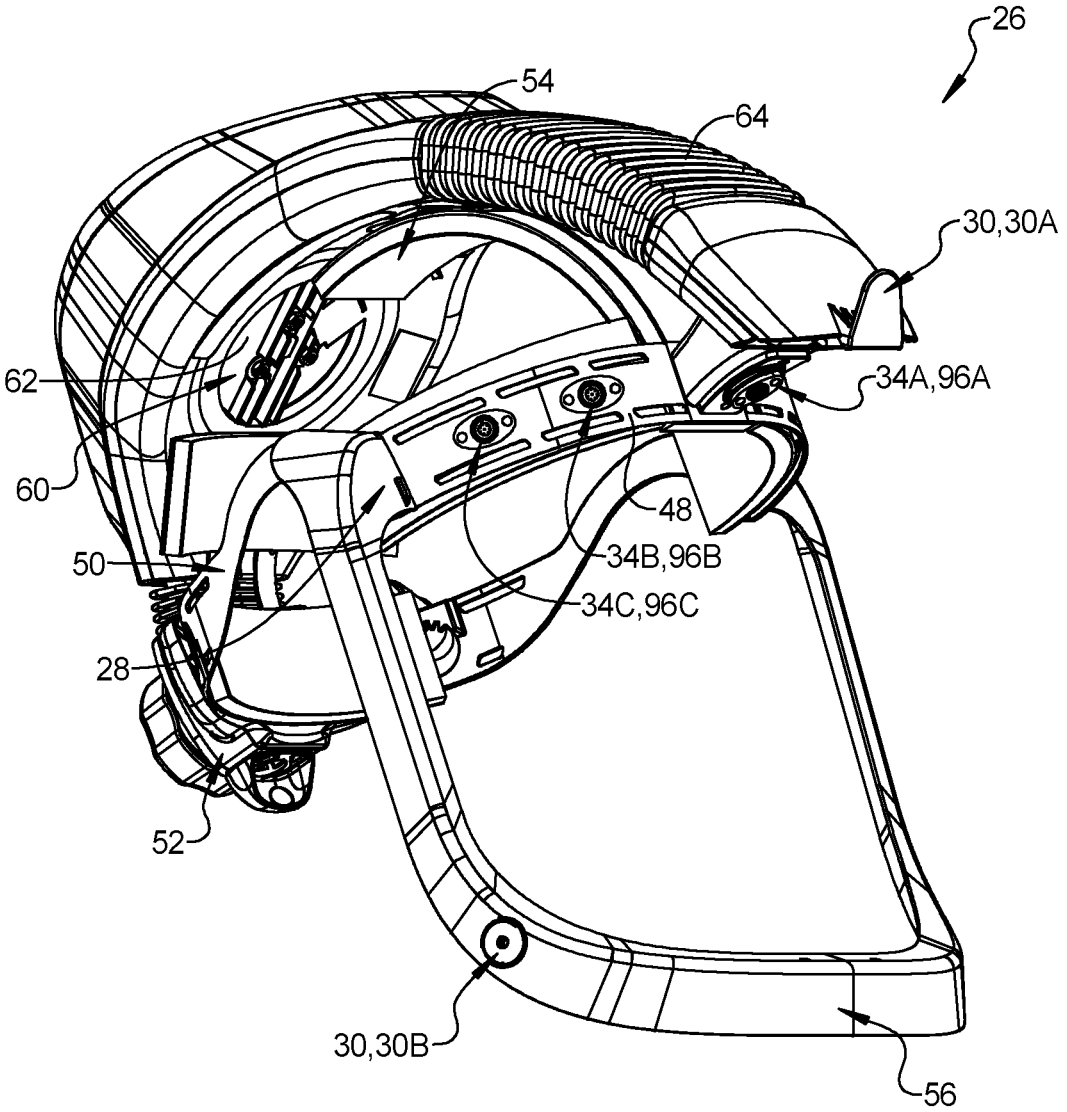
FIG. 5A is a perspective view of the headpiece of FIGS. 2-4, show with multiple headpiece connectors.
Figure 5B:
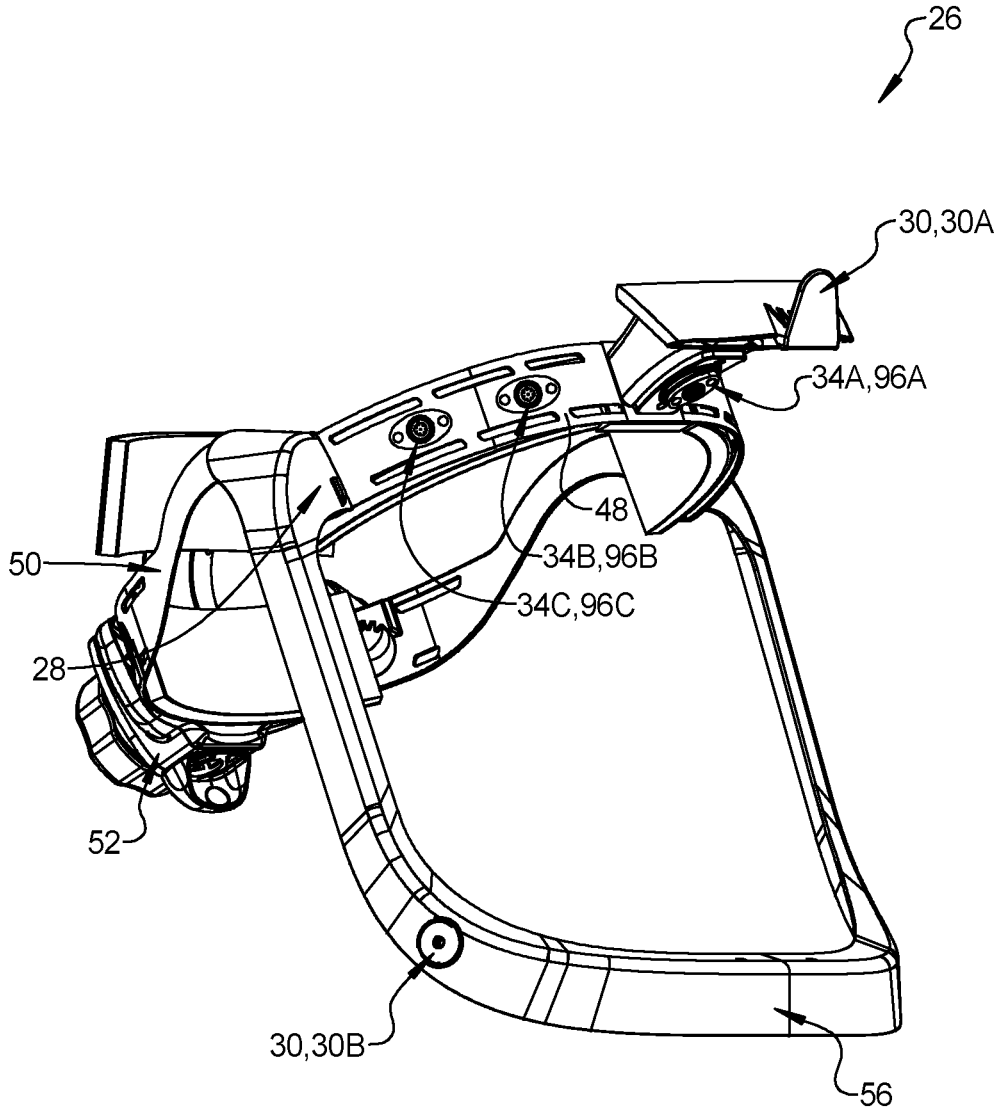
FIG. 5B is a perspective view of another embodiment of a head unit system shown having the headpiece connector of FIG. 5A.

The device connector 40 and the headpiece connector 34 cooperate to releasably attach the peripheral device 38 to the headpiece 26 in a secured configuration, generally indicated at 44 (see FIGS. 2 and 3). The headpiece contact 36 and the device contact 42 abut in the secured configuration 44 so as to facilitate electrical connection between the headpiece 26 and the secured peripheral device 38. As will be appreciated from the subsequent description of the embodiments of the head unit system 24 below, the headpiece 26, the support structure 28, the connectors 34, 40, the contacts 36, 42, and/or the peripheral device 38 can be realized, configured, or otherwise arranged in a number of different ways. Each of these components will be described in greater detail below.

As noted above, the headpiece 26 is adapted to be worn over the head 22 of the user 20. As will be appreciated from the subsequent description below, the headpiece 26 can be configured in a number of different ways sufficient to be removably attached to the head 22 of the user 20 and, thus, could employ a number of different structural features or components which cooperate to that end.

In the representative embodiment illustrated in FIG. 1, the headpiece 26 may also be referred to as a helmet which supports both the face shield 32 and a surgical gown (sometimes referred to as a "hood" or "toga"), generally indicated at 46. The surgical gown 46 and the face shield 32, which may be transparent, cooperate to provide personal protection to the user 20 by preventing contact exposure to blood, tissue, bone fragments, and the like during execution of medical procedures, such as blood splatter dispersed by a surgical instrument.

The surgical gown 46 is typically disposable and may be formed integrally with the face shield 32 such that when the face shield 32 is secured to the shield mount 30, the gown 46 is likewise secured to the support structure 28. However, the gown 46 could be formed separately from the face shield 32 and, thus, could be secured to the support structure 28, or any other suitable part of the headpiece 26, in any suitable way. Moreover, while the gown 46 cooperates with the face shield 32 and the head unit system 24 so as to provide a protective barrier for the user 20, those having ordinary skill in the art will appreciate that the gown 46 could be omitted for certain applications, such as for use during medical practices and procedures where a face shield 32 provides the user 20 with adequate personal protection. By way of non-limiting example, in the representative embodiment illustrated in FIG. 19, the headpiece 26 is secured to the head 22 and supports the face shield 32 without a gown 46. As such, those having ordinary skill in the art will appreciate that the headpiece 26 could have any suitable configuration sufficient to be worn over the head 22 of the user 20 and to support one or more secured peripheral devices 38, as described in greater detail below. Moreover, it will be appreciated that the headpiece 26 could be configured to support one or more secured peripheral devices 38 without the use of a face shield 32 and/or gown 46.

Referring now to FIG. 2, the head unit system 24 is shown with the face shield 32 secured to the shield mount 30 of the headpiece 26. In the embodiment of the head unit system 24 illustrated in FIGS. 2-5B, the support structure 28 of the headpiece 26 includes a front support section 48 connected to a rear support section 50. Here, the front support section 48 is arranged to abut the forehead of the user 20, and the rear support section 50 is arranged to abut the back of the head 22 of the user 20. The rear support section 50 includes a tensioner, generally indicated at 52, which is employed to adjust the fit of the support structure 28 so as to accommodate heads 22 of different sizes and shapes. An upper section, generally indicated at 54, extends between the rear support section 50 and the front support section 48 over the top of the head 22 of the user 20. A facial section, generally indicated at 56, is operatively attached to the front support section 48 arranged so as to be positioned in front of the head 22 of the user 20. As noted above, the support structure 28 could be configured in a number of different ways and, thus, it will be appreciated that the sections and components described above could be arranged, shaped, or configured in a number of different ways, or could be omitted entirely, depending on specific application requirements of the headpiece 26 of the head unit system 24. By way of non-limiting example, the support structure 28 of the headpiece 26 could be realized without a discrete upper section 54 or facial section 56.

In the representative embodiment illustrated in FIGS. 2-5B, the headpiece 26 includes an upper mount 30A and a lower mount 30B. Here, the upper mount 30A is realized as a tab-shaped protrusion operatively attached to the upper section 54 of the support structure 28. The upper mount 30A engages a corresponding upper shield mount 58A defined in the face shield 32. In this embodiment, the upper shield mount 58A of the face shield 32 is realized as an aperture which engages the upper mount 30A of the headpiece 26. Here too in this embodiment, the lower mount 30B is likewise operatively attached to the support structure 28 and also engages a corresponding shield mount 58B of the face shield 32. It will be appreciated that the headpiece 26 may include a pair of lower mounts 30B spaced along the facial section 56 of the support structure 28 for engaging respective corresponding shield mounts 58B of the face shield 32.

Those having ordinary skill in the art will appreciate that the mounts 30A, 30B of the headpiece 26 and/or the shield mounts 58A, 58B of the face shield 32 could be arranged or otherwise configured in any suitable way sufficient effect releasable attachment of the face shield 32 to the headpiece 26, as noted above. By way of non-limiting example, the mounts 30A, 30B, 58A, 58B may be complimentary fasteners such as hook-and-loop fasteners, magnetic fasteners, and the like. Moreover, it will be appreciated that the head unit system 24 could employ any suitable number of mounts 30A, 30B, 58A, 58B in any suitable arrangement. Furthermore, it will be appreciated that the mounts 30A, 30B could be formed integrally with or otherwise operatively attached to any suitable portion or component of the support structure 28 of the headpiece 26. Similarly, it will be appreciated that the shield mounts 58A, 58B could be formed integrally with or otherwise operatively attached to any suitable portion or component of the face shield 32.

In the embodiment illustrated in FIGS. 2-5A, the headpiece 26 includes an air distribution system, generally indicated at 60, that is operatively attached to the support structure 28 and is configured to distribute air about the head 22 of the user 20. To that end, the air distribution system 60 depicted employs a fan module, generally indicated at 62 (see also FIG. 15A). In this embodiment, the fan module 62 directs air through a channel member 64 towards the head 22 of the user 20 so as to prevent heat and $CO_2$ from accumulating under the gown 46 which could otherwise become trapped by and/or accumulate in the headpiece 26, such as where a surgical gown 46 is employed to provide the personal protective barrier along with the face shield 32, as described above. However, those having ordinary skill in the art will appreciate that the headpiece 26 could omit an integrated air distribution system 60 for certain applications, such as in the embodiment of the headpiece 26 depicted in FIG. 5B. Moreover, as will be appreciated from the subsequent description below, the fan module 62 could be implemented into the peripheral device 38 for certain applications of the head unit system 24 (see also FIG. 15B).

Figure 7:
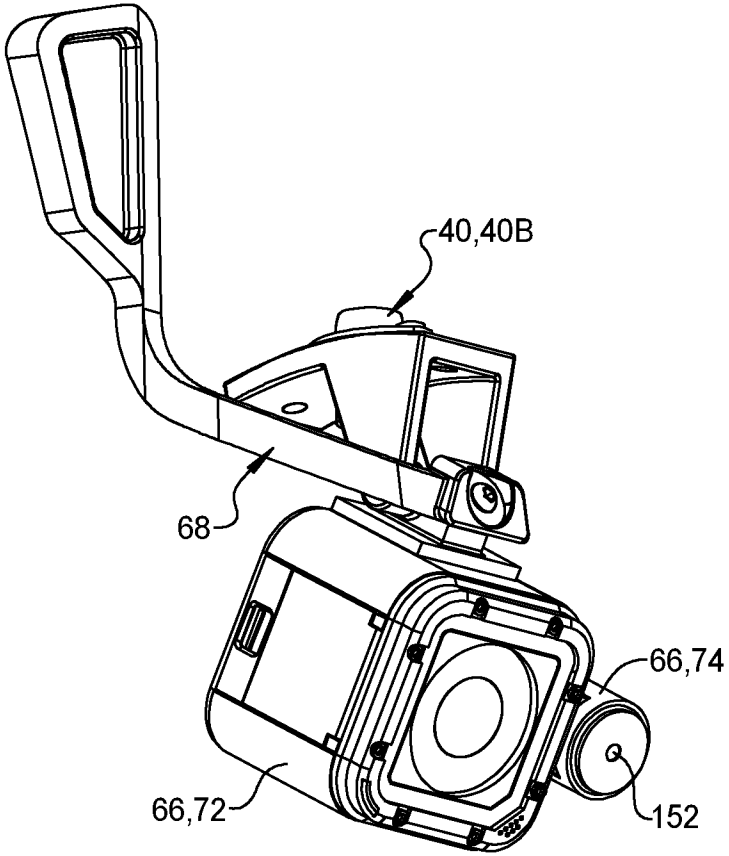
FIG. 7 is a perspective view of an alternate peripheral device.
Figure 6:
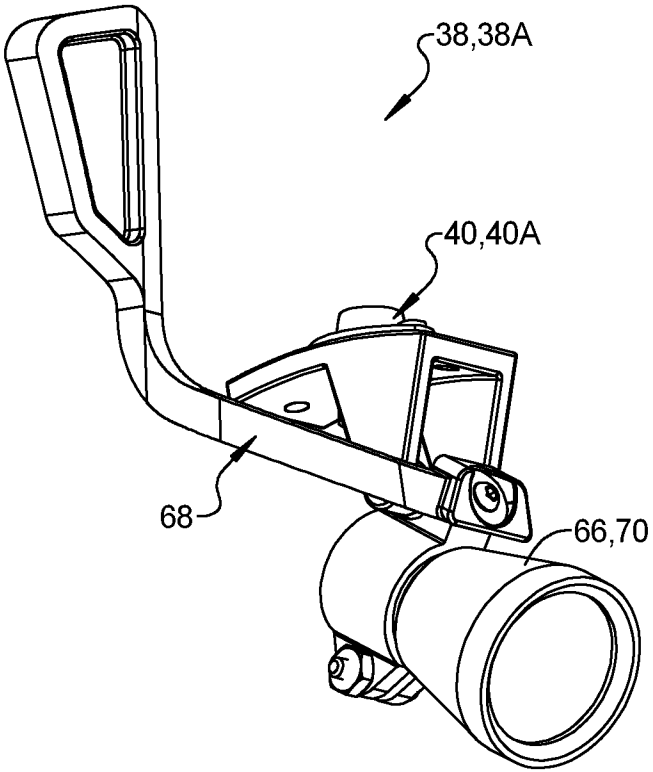
FIG. 6 is a perspective view of the peripheral device of FIGS. 2-4.
Figure 8:
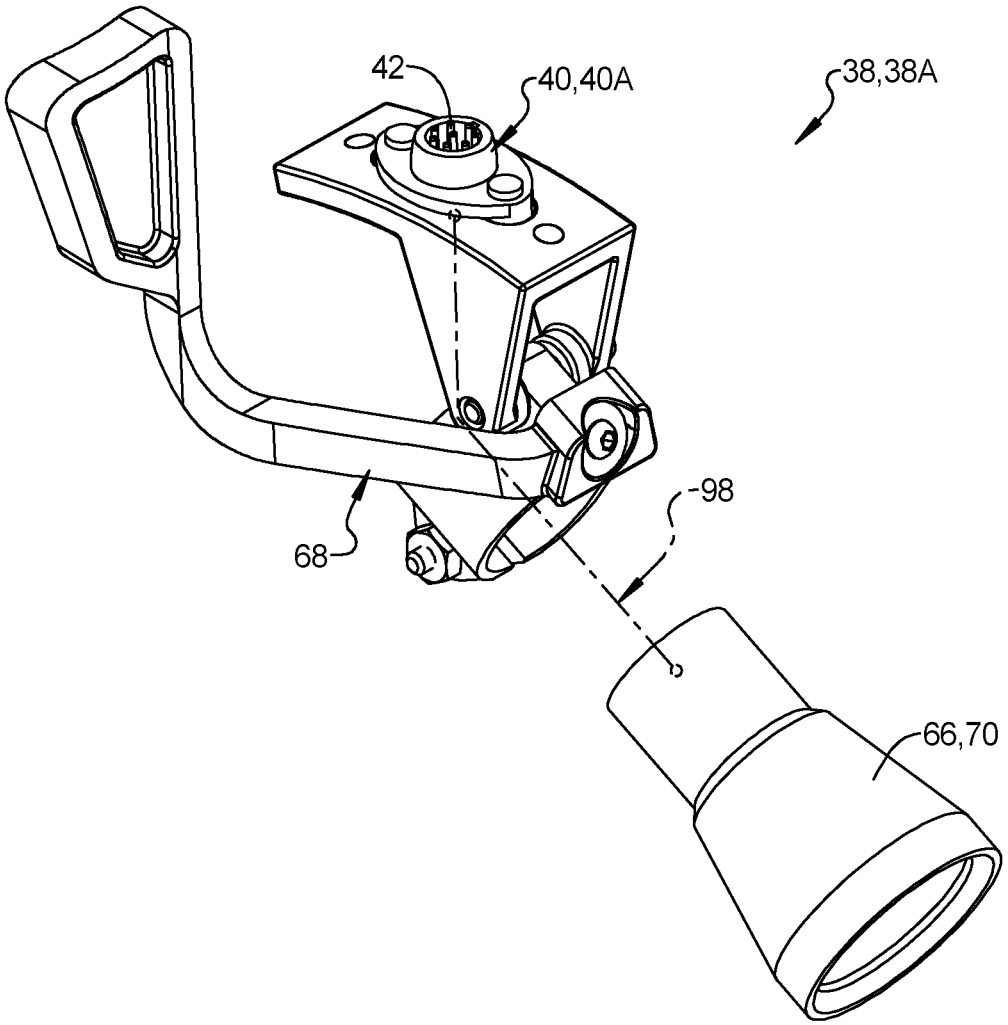
FIG. 8 is a partial exploded perspective view of the peripheral device of FIG. 6, showing a peripheral device module and a device connector coupled to an adjustment linkage.

Referring now to FIGS. 6-8, as noted above, the peripheral device 38 could be realized in a number of different ways depending on the specific application requirements of the head unit system 24. As shown best in FIG. 8, in one embodiment, the peripheral device 38 includes at least one peripheral device module 66 disposed in electrical communication with the device connector 40 and supported for concurrent movement therewith. Here, the peripheral device 38 also includes an adjustment linkage, generally indicated at 68, interposed between the peripheral device module 66 and the device connector 40 for selectively adjusting a relative position of the peripheral device module 66 with respect to the device connector 40 and, thus, with respect to the headpiece 26 when in the secured configuration 44. It will be appreciated that this arrangement allows the user 20 to selectively position the respective peripheral device module 66 with respect to the headpiece 26. Moreover, it will be appreciated that the adjustment linkage 68 could employ any suitable structure sufficient to selectively adjust the relative position of the peripheral device module 66 in any suitable way. Similarly, the adjustment linkage 68 could be omitted entirely and the peripheral device module 66 could be operatively attached to the device connector 40 in any suitable way.

Figure 15A:
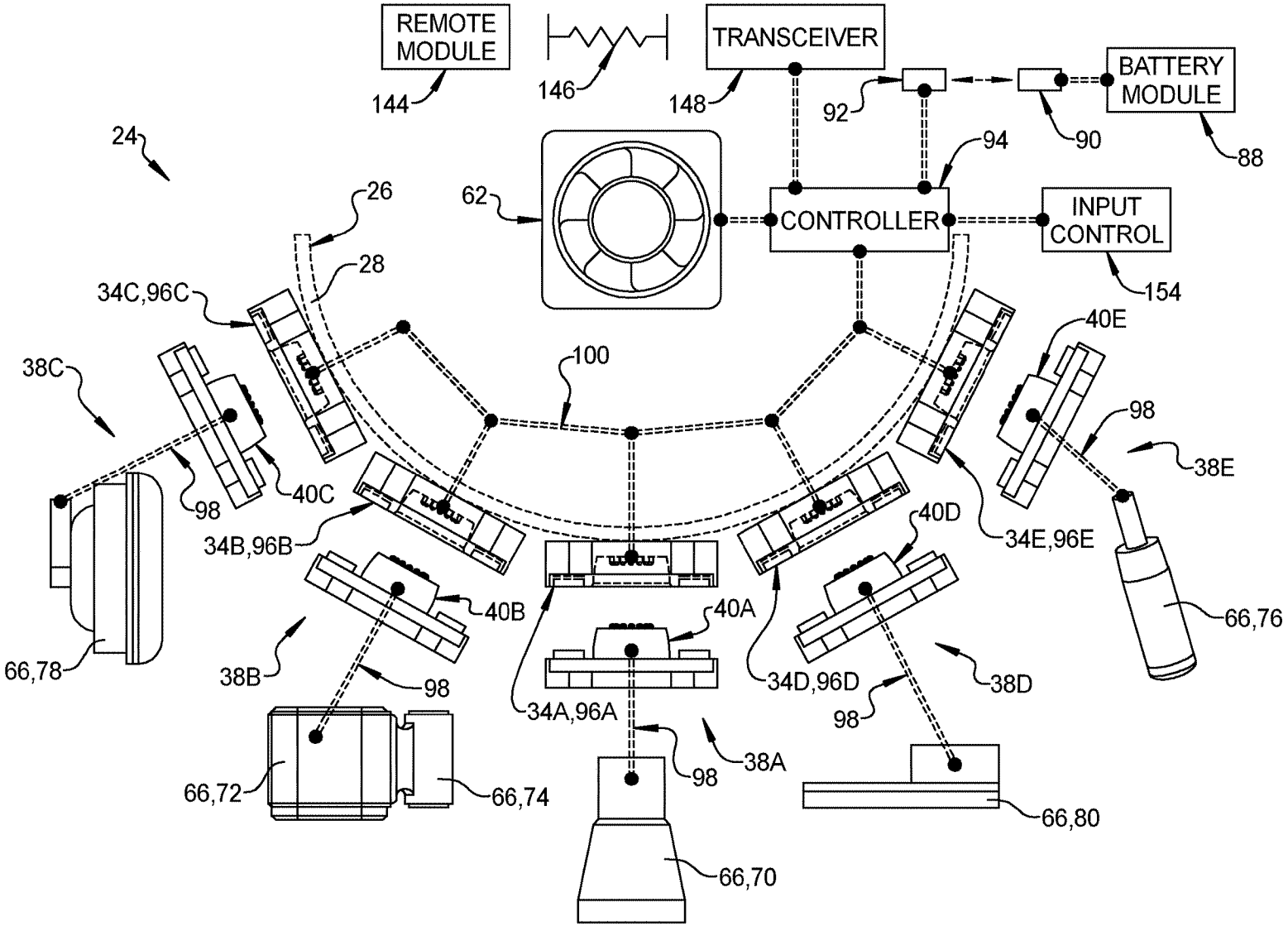
FIG. 15A is a top-side schematic view of one embodiment of a head unit system shown with a plurality of peripheral devices spaced adjacent to a corresponding plurality of headpiece connectors defining respective mounting positions for peripheral devices.
Figure 15B:
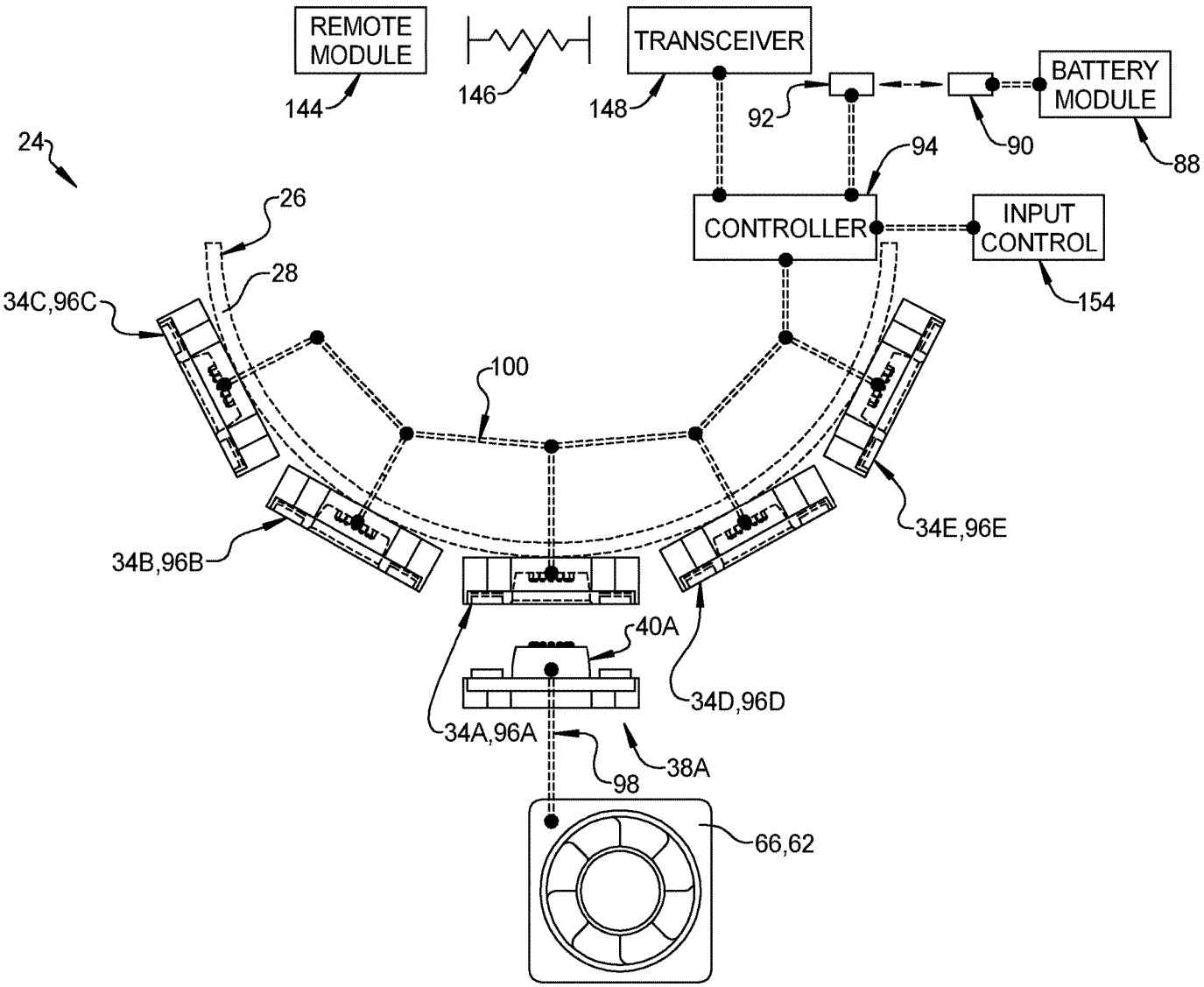
FIG. 15B is a top-side schematic view of another embodiment of the head unit system of FIG. 15A shown with a peripheral device spaced adjacent to one of a plurality of headpiece connectors defining respective mounting positions for peripheral devices.

As is described in greater detail below, the peripheral device module 66 could be realized in a number of different ways and could be generally configured to afford the user 20 with enhanced sensory perception; the ability to record, receive, and/or transmit visual and/or audible information, and the like. With reference to FIG. 15A, and by way of non-limiting example, the peripheral device module 66 could be realized as a light source 70, a camera 72, a projection module 74, a microphone 76, a speaker 78, a visual display module 80, and/or any other suitable type of module sufficient to be secured to the headpiece 26 for use by the user 20. Moreover, as noted above, the peripheral device module 66 could be realized as a fan module 62 as depicted in FIG. 15B.

Figure 9:
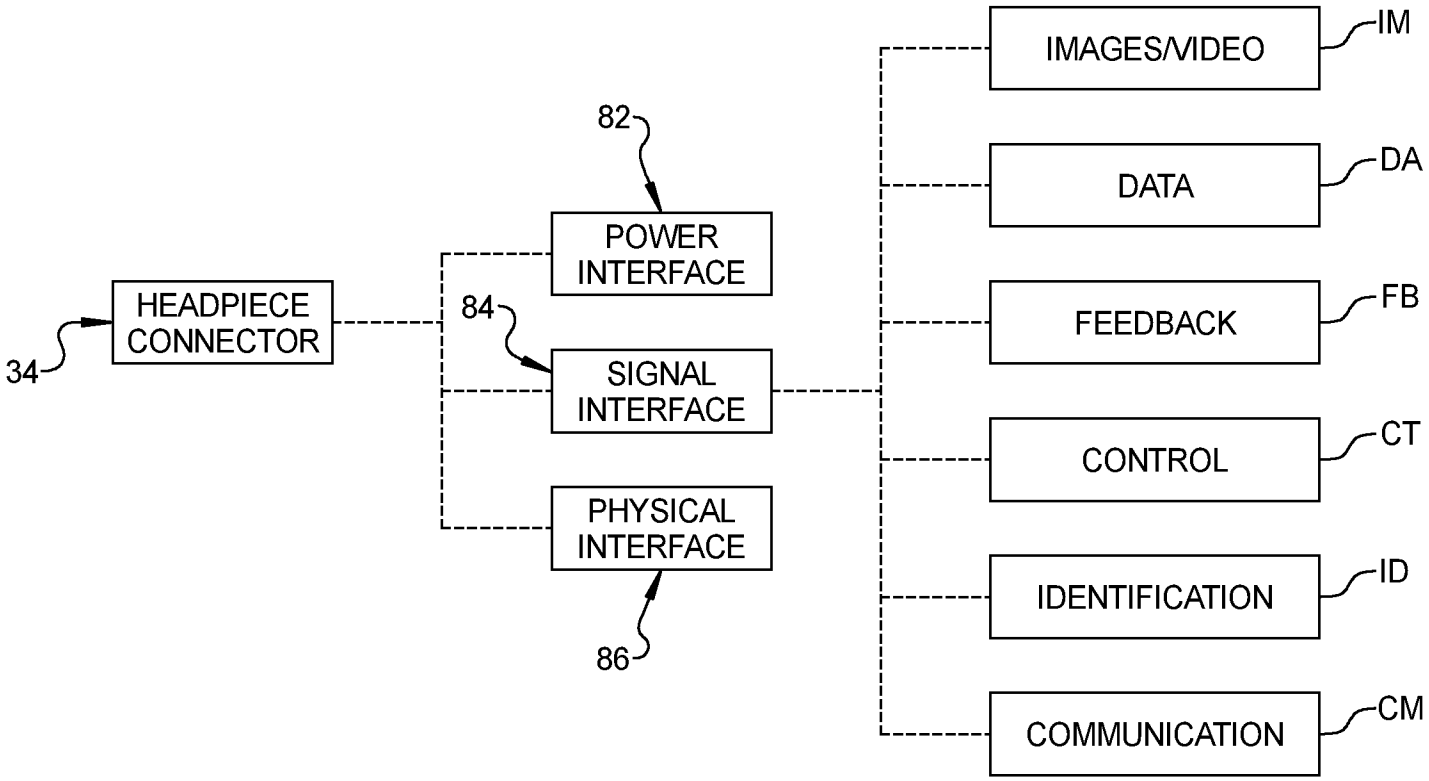
FIG. 9 is a diagrammatic representation of interfaces afforded by the headpiece connector of FIGS. 5A and 5B.
Figure 10B:
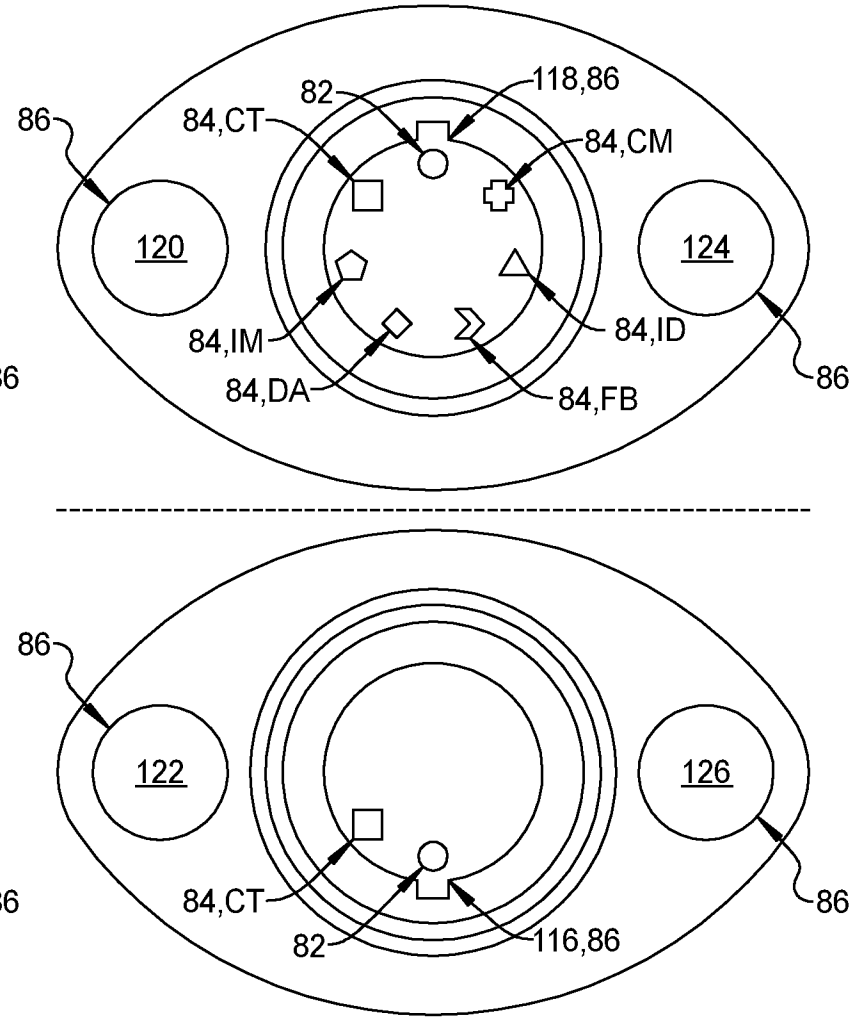
FIG. 10B is another front-side schematic representation of the headpiece connector of FIG. 10A and an alternate mirrored device connector according to another embodiment.

With reference now to FIGS. 9 and 10, as noted above, the headpiece 26 includes one or more headpiece connectors 34 operatively attached to the support structure 28 which, in turn, cooperate with the device connector 40 so as to secure and communicate with the peripheral device 38. More specifically, in one embodiment, the headpiece connectors 34 include a power interface, generally indicated at 82, a signal interface, generally indicated at 84, and a physical interface, generally indicated at 86. As will be appreciated from the subsequent description of the interfaces 82, 84, 86 below, any combination of the interfaces 82, 84, 86 could be utilized in any suitable way.

The power interface 82 is configured to provide a source of electrical power to the peripheral device module 66 of the secured peripheral device 38, such as direct current electricity communicated from the headpiece 26 via one or more headpiece contacts 36. To that end, and as shown in phantom in FIG. 1, a battery module 88 is employed to provide a source of electrical power to the secured peripheral device 38. Here, the battery module 88 may be secured to the user 20 spaced from the headpiece 26, such as on a belt or in a pocket. However, it is also conceivable that the battery module 88 could be secured directly to the headpiece 26 for concurrent movement, or could otherwise be secured in any other suitable location in any suitable way. As shown in FIGS. 1, 15A, and 15B, in one embodiment, the headpiece 26 further includes an interface connector, generally indicated at 90, operatively attached to the support structure 28. The interface connector 90 is disposed in electrical communication with the headpiece connector 34 and is configured to communicate electrical power with the secured peripheral device 38 across the power interface 82 of the headpiece connector 34. In one embodiment, the battery module 88 has a tether connector 92 configured for removable attachment to the interface connector 90 of the headpiece 26.

The signal interface 84 is configured to facilitate one-way or two-way communication between the headpiece 26 and the secured peripheral device 38. Thus, through the signal interface 84, the peripheral device 38 can transmit and/or receive various types of information to and/or from the headpiece 26 so as to control or otherwise aid in the operation of the peripheral device 38. Here, the communication may be electrical communication effected via electrical signals communicated from the headpiece 26 via one or more headpiece contacts 36 disposed in electrical communication with one or more controllers, generally indicated at 94 and described in greater detail below (see FIGS. 15A and 15B). However, those having ordinary skill in the art will appreciate that the signal interface 84 could be realized in a number of different ways sufficient to effect communication between the headpiece 26 and the secured peripheral device 38, such as by fiber optic communication and the like.

As illustrated in FIGS. 9 and 10, depending on the specific configuration of the head unit system 24 and/or the peripheral device module 66 of the peripheral device 38, the signal interface 84 can be employed to transmit various types of information, including but not limited to information related to: images/video IM captured by the peripheral device; data DA information concerning operation conditions of the peripheral device 38; feedback FB information from the peripheral device 38 to the controller 94 that may aid in the control of the peripheral device 38; control CT information sent by the controller 94 to the peripheral device 38 to control the operation of the peripheral device 38; identification ID information related to the identify of the peripheral device 38; and/or communication CD information related to visual and/or audio signals communicated with the controller 94. It will be appreciated that the signal interface 84 could be configured so as to allow communication of only a limited sub-set of information of any suitable type. Moreover, it will be appreciated that one or more types of information described above may be transmitted from or otherwise to the secured peripheral device 38 wirelessly, without the use of the signal interface 84, as is described in greater detail below.

Figure 10A:
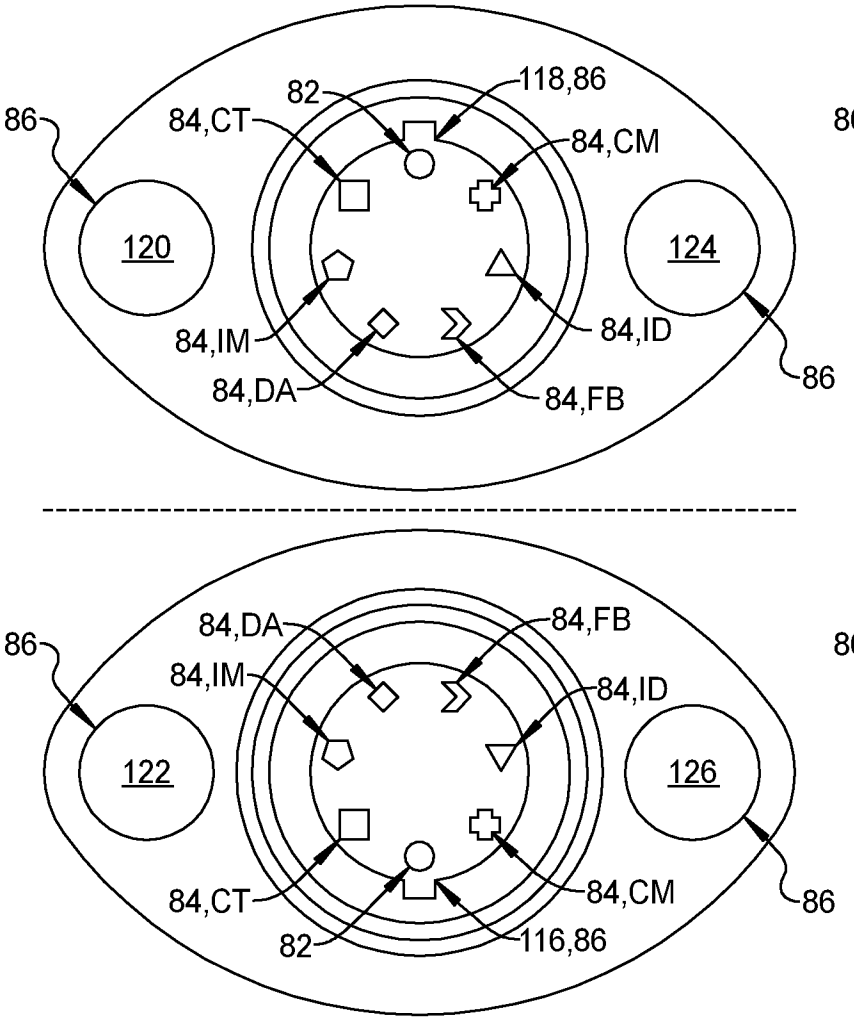
FIG. 10A is a front-side schematic representation of a headpiece connector and a mirrored device connector showing the interfaces of FIG. 9 according to one embodiment.

It will be appreciated that the signal interface 84 can be utilized in different ways depending on the type of peripheral device module 66 utilized. By way of example, as shown in FIG. 10A, where the peripheral device module 66 is realized as a camera 72, the signal interface 84 may be used to facilitate control CT (for example, begin or stop recording images/video), identification ID (for example, to distinguish different types of cameras 72 to ensure proper operation), images/video IM (for example, for storing or transmitting captured images), feedback FB (for example, adjusting camera 72 settings based on use), communication CM (for example, live video feed to another medical professional), and/or data DA (for example, duration of use). However, it will be appreciated that other types of peripheral device modules 66 could employ the signal interface 84 in different ways. By way of non-limiting example, and with reference to FIG. 10B, where the peripheral device module 66 is realized as a light source 70, the signal interface 84 may be used to facilitate control CT (for example, to control light intensity), and identification ID (for example, to distinguish different types of light sources 70 to ensure proper operation).

In one embodiment, the controller 94 is configured to limit or otherwise prevent operation of the secured peripheral device 38 in response to predetermined information communicated across the signal interface 84. By way of non-limiting example, the controller 94 could determine, such as via the signal interface 84, that a peripheral device 38 has been connected to the headpiece 26 in the secured configuration 44. Here, if the controller 94 were to determine that the secured peripheral device 38 included an unrecognized (or, unauthorized) peripheral device module 66, the controller 94 could subsequently interrupt or limit power to the respective device connector 40 in response. To this end, the controller 94 could be provided with memory in which predetermined identification ID information data are stored, which may be used to authenticate peripheral devices 38 and/or specific peripheral device modules 66. The peripheral devices 38 and/or peripheral device modules 66 could likewise be provided with memory in which predetermined identification ID data are stored (for example, corresponding to data stored in a "lookup table" stored in memory of the controller 94). These predetermined identification ID information data may also be used to define operational parameters of the peripheral device modules 66 (for example: electrical requirements, communication protocols, etc.) to subsequently facilitate proper operation of the peripheral device 38 via the controller 94, as noted above.

It will be appreciated that other types of authentication may be employed by the head unit system 24 to prevent or otherwise restrict the use of the headpiece 26 with unauthorized peripheral devices and/or peripheral device modules or, conversely, to prevent or otherwise restrict the use of the peripheral device 38 with unauthorized headpieces. By way of non-limiting example, the head unit system 24 could employ Radio-Frequency Identification (RFID) to authenticate and/or identify the peripheral device 38 in addition to information communicated across the signal interface 84.

The physical interface 86 is configured to effect releasable attachment of the peripheral device 38 to the headpiece 26 in the secured configuration 44. More specifically, the physical interface 86 ensures concurrent movement between the headpiece 26 and the secured peripheral device 38 while, at the same time, facilitating connection of the peripheral device 38 to the power interface 82 and/or the signal interface 84. As is described in greater detail below, the physical interface 86 can be configured in a number of different ways to facilitate releasable attachment to the peripheral device 38. Moreover, the physical interface 86 can be employed to secure the peripheral device 38 in different ways depending on application requirements. As shown in FIG. 2, the secured peripheral device 38 is positioned behind the face shield 32 of the head unit system 24 at a location that is generally intended to be centered with respect to the head 22 of the user 20. However, as will be appreciated from the subsequent description below, one or more peripheral devices 38 could be secured in different respective orientations and/or positions with respect to the head 22 of the user 20 and/or the face shield 32. Moreover, different types of peripheral devices 38 can be secured to the headpiece 26 in different predetermined mounting positions 96, depending on application requirements of the head unit system 24.

As noted above, in one embodiment, the device connector 40 of the peripheral device 38 is removably secured to the headpiece connector 34 of the headpiece 26 via the physical interface 86 so as to effect electrical communication via the power interface 82 and/or the signal interface 84 via direct electrical connection across the headpiece contact 36 and the device contact 42 in the secured configuration 44, as noted above. Thus, it will be appreciated that the secured peripheral device 38 can be powered by and/or communicate electrically with the headpiece 26 via the power interface 82 and/or signal interface 84 which, in turn, can communicate with or be provided power by one or more additional systems or modules.

With reference now to FIGS. 15A and 15B, various peripheral device modules 66 described above are shown disposed in electrical communication respective device connectors 40 via a device electrical bus, generally indicated at 98. It will be appreciated that the device electrical bus 98 could be of any suitable type or configuration sufficient to communicate electrical power and/or electrical signals between the respective peripheral device module 66 of the secured peripheral device 38 and the headpiece 26, via one or more contacts 36, 42 in the connectors 34, 40. Moreover, it will be appreciated that different types of peripheral device modules 66 may employ different types of electrical communication protocols, such as I2C or CAN bus, which utilize correspondingly different electrical circuity and/or power requirements to interact with the power interface 82 and/or the signal interface 84. By way of non-limiting example, the device electrical bus 98 for a device module 66 realized as a light source 70 may employ a connection across the power interface 82 and a control CT connection across the signal interface 84 (see also FIG. 10B), while the device electrical bus 98 for a device module 66 realized as a camera 72 or a visual display module 80 may require additional connections across the signal interface 84 (see also FIG. 10A) for interacting with the headpiece 26.

Figure 17:
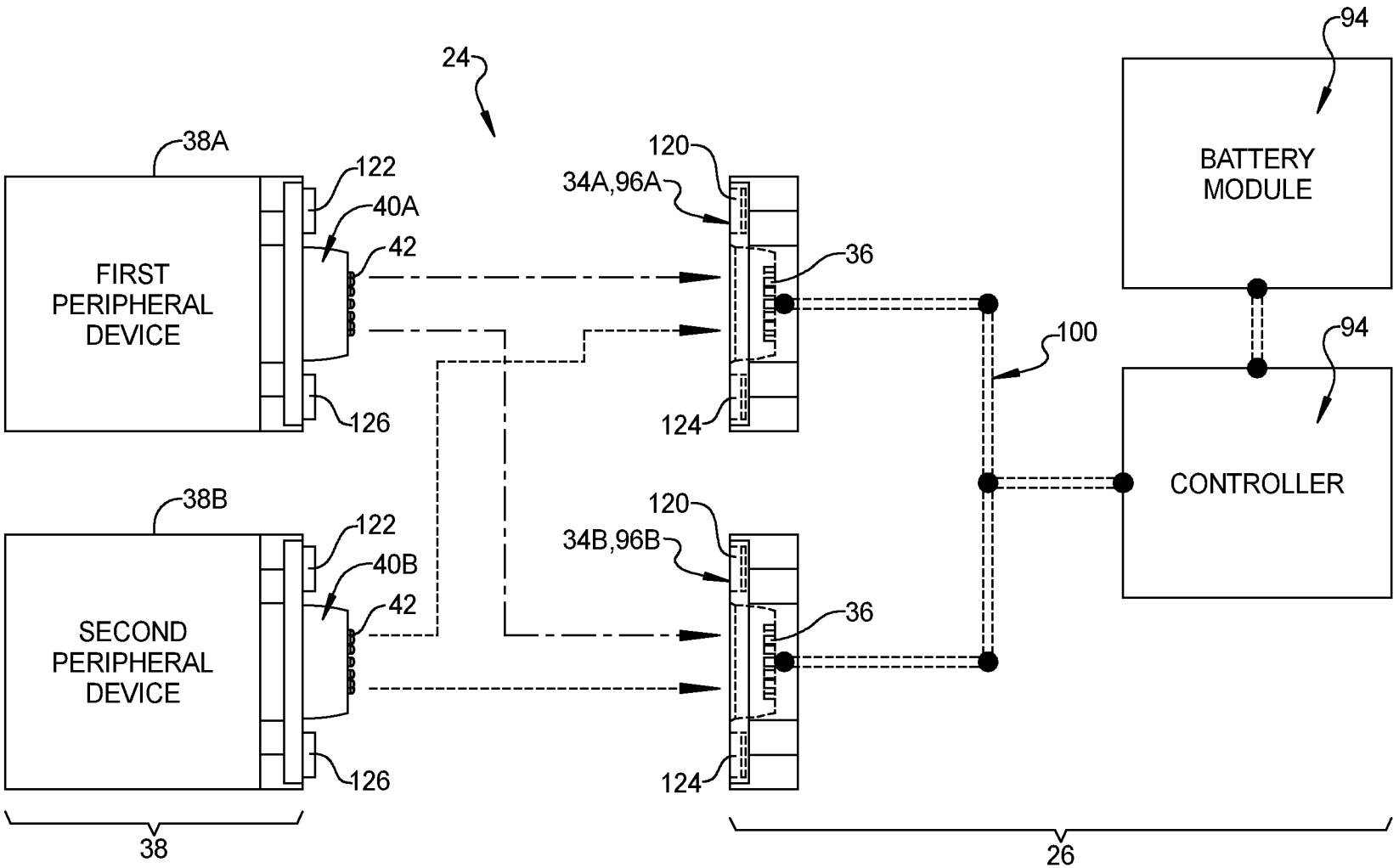
FIG. 17 is a top-side schematic view of a pair of headpiece connectors shown adjacent to first and second peripheral devices so as to depict interchangeable mounting positions.

As noted above, the headpiece 26 may advantageously include multiple headpiece connectors 34 that are arranged for connection with different types of peripheral devices 38 and, thus, with different types of peripheral device modules 66. As such, the power interface 82, the signal interface 84, and the physical interface 86 of the headpiece connector 34 are configured to facilitate interchangeable releasable attachment of any peripheral device 38 to any suitable device connector 40 in any of the mounting positions 96 of the headpiece 26. To that end, in one embodiment, the headpiece connector 34 is further defined as a first headpiece connector 34A, and the headpiece 26 of the head unit system 24 includes a second headpiece connector 34B operatively attached to the support structure 28. Here, each of the headpiece connectors 34A, 34B defines a respective predetermined mounting position 96A, 96B of the headpiece 26 for selectively and interchangeably securing the peripheral device 38 in one of the mounting positions 96A, 96B. Specifically, as shown in FIG. 17, the device connector 40A of a first peripheral device 38A is configured to be secured to different headpiece connectors 34A, 34B (see dash-dot-dash arrows from the first peripheral device 38A), and the device connector 40B of a second peripheral device 38B is configured to likewise be secured to different headpiece connectors 34A, 34B (see dot-dot arrows from the second peripheral device 38B). This affords the user 20 with broad flexibility in the arrangement and orientation of different peripheral devices 38 in use.

It should be appreciated that certain headpiece connectors 34A, 34B may include fewer than all of the power interface 82, the signal interface 84, and the physical interface 86. Furthermore, it is conceivable that all device connectors 34A, 34B could include the same interfaces 82, 84, 86 so as to allow different peripheral devices 38 to connect to any of the available device connectors 34A, 34B.

Figure 16:
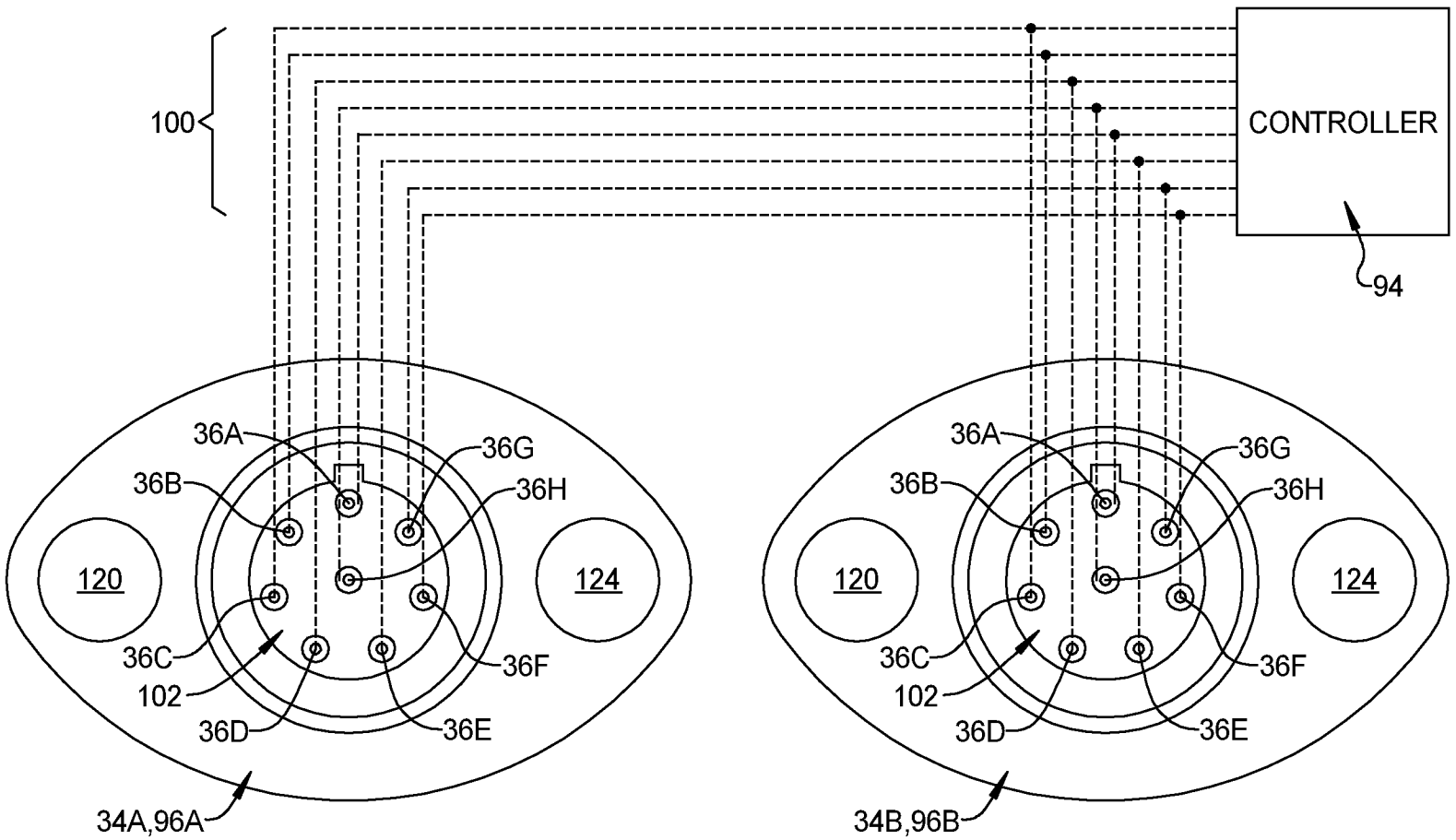
FIG. 16 is a front-side schematic view of a pair of headpiece connectors shown wired in parallel and disposed in electrical communication with a controller.

As shown in FIGS. 2-5, the headpiece connectors 34A, 34B are spaced from each other about the support structure 28 of the headpiece 26. Similarly, as shown in FIGS. 15A and 16-17, in one embodiment, the peripheral device 38 is further defined as a first peripheral device 38A with a first peripheral device connector 40A, and the head unit system 24 further includes a second peripheral device 38B with a second peripheral device connector 40B. Here, the first and second peripheral devices 38A, 38B may each be secured to the support structure 28 so as to define the different mounting positions 96A, 96B.

In the representative embodiment of the headpiece 26 illustrated herein, a total of five mounting positions 96A, 96B, 96C, 96D, 96E are provided and are defined by respective headpiece connectors 34A, 34B, 34C, 34D, 34E operatively attached to the support structure 28 (see FIGS. 15A and 15B). Thus, in this embodiment, up to five different peripheral devices 38A, 38B, 38C, 38D, 38E can be secured to the headpiece 26 in different respective mounting positions 96A, 96B, 96C, 96D, 96E. However, it will be appreciated that any suitable number of headpiece connectors 34 could be employed by the headpiece 26 so as to secure any suitable number of peripheral devices 38.

Figure 12:
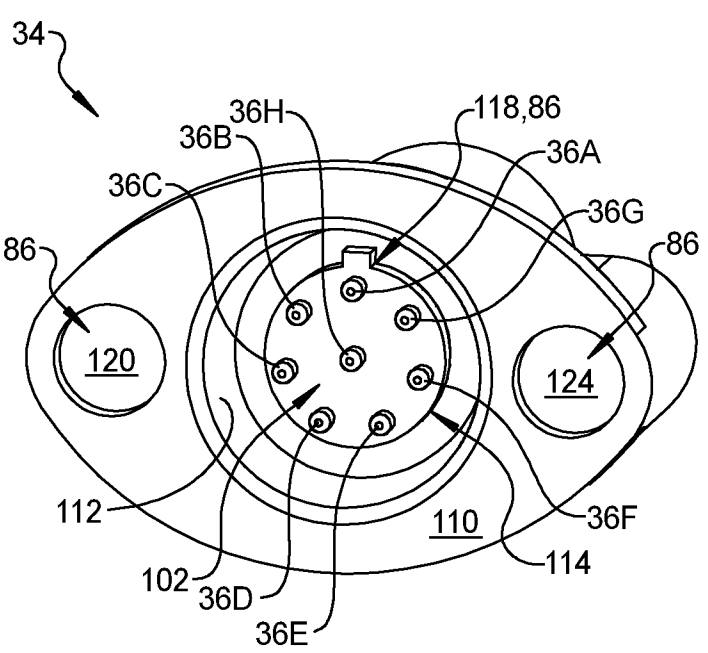
FIG. 12 is a perspective view of the headpiece connector of FIGS. 5A and 5B.

As shown best in FIGS. 12 and 16, in one embodiment, each of the headpiece connectors 34 includes a plurality of headpiece contacts 36A, 36B, 36C, 36D, 36E, 36F, 36G, 36H arranged such that at least one of the headpiece contacts 36A, 36B, 36C, 36D, 36E, 36F, 36G, 36H abuts the device contact 42 of the device connector 40 in the secured configuration 44. As noted above, while the headpiece contacts 36 and device contacts 42 abut in electrical connection in the secured configuration 44, those having ordinary skill in the art will appreciate that communication of information could be effected across the signal interface 84 in other ways, such as via fiber optic connection.

Figure 11:
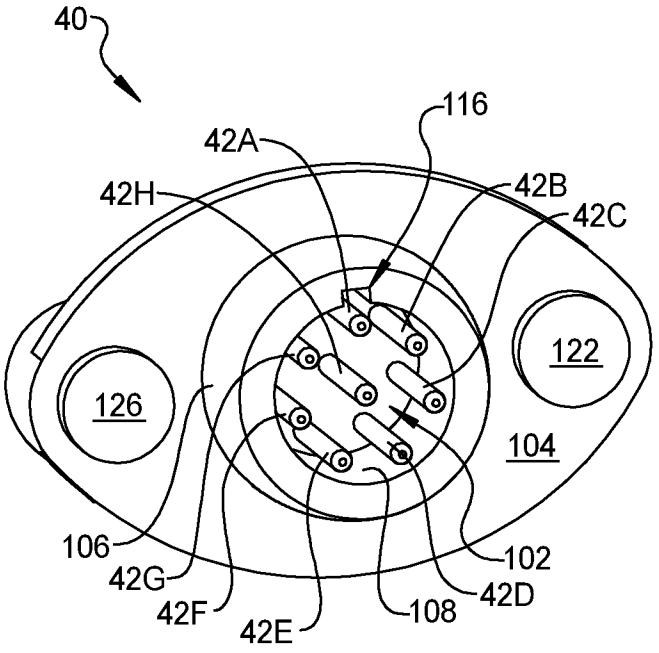
FIG. 11 is a perspective view of the device connector of FIG. 8.

As shown in FIG. 11, in one embodiment, the device connector 40 includes a plurality of device contacts 42A, 42B, 42C, 42D, 42E, 42F, 42G, 42H arranged such that each one of the device contacts 42A, 42B, 42C, 42D, 42E, 42F, 42G, 42H abuts a corresponding one of the headpiece contacts 36A, 36B, 36C, 36D, 36E, 36F, 36G, 36H of the headpiece connector 34 in the secured configuration 44. Here, each of the connectors 34, 40 includes a total of eight contacts 36, 42 arranged for corresponding abutment (i.e.: device contact 42*n* abuts headpiece contact 36*n* in the secured configuration 44). In one embodiment, the respective headpiece connectors 34A, 34B, 34C, 34D, 34E are each electrically connected in parallel with one other along at least one common electrical path, generally indicated at 100. More specifically, respective headpiece contacts 36A, 36B, 36C, 36D, 36E, 36F, 36G, 36H of each of the headpiece connectors 34A, 34B, 34C, 34D, 34E are respectively wired together in parallel (see FIG. 16). Here, it will be appreciated that one or more of the headpiece contacts 36A, 36B, 36C, 36D, 36E, 36F, 36G, 36H could form a part of the power interface 82 and/or the signal interface 84. For example, two of the headpiece contacts 36A, 36B could be configured to transmit control CT information across the signal interface 84, whereas another two of the headpiece contacts 36C, 36D could be configured to transmit electrical power across the power interface 82.

Advantageously, each of the headpiece connectors 34A, 34B, 34C, 34D, 34E includes the same number of headpiece contacts 36A, 36B, 36C, 36D, 36E, 36F, 36G, 36H arranged in a common pattern 102 with respect to each other. As shown in FIGS. 11-14 and 16, the common pattern 102 has a central contact surrounded by an additional seven radially-spaced contacts. However, those having ordinary skill in the art will appreciate that the common pattern 102 could have any suitable profile, defined or otherwise arranged in any suitable way, and with any suitable number of pins. Moreover, while the contacts 36, 42 are shown as similarly sized in FIGS. 11-14, it will be appreciated that different sizes, shapes, and/or configurations of contacts 36, 42 could be employed in certain applications.

The device contacts 42A, 42B, 42C, 42D, 42E, 42F, 42G, 42H are likewise arranged so as to mirror the common pattern 102 (compare FIGS. 11 and 12). Here, it is advantageous for each of the headpiece connectors 34 to include the same number of headpiece contacts 36 arranged in the common pattern 102 such that peripheral devices 38 can be interchanged between mounting positions 96, as noted above. However, it will be appreciated that the device connector 40 for certain peripheral devices 38 could include fewer device contacts 42 still arranged so as to mirror the common pattern 102 of the headpiece connector 34. By way of non-limiting example, the device connector 40 for a peripheral device 38 employing a light source 70 peripheral device module 66 may only require two device contacts 42A, 42B to power the light source 70 and, thus, could omit six device contacts 42C, 42D, 42E, 42F, 42G, 42H which could otherwise be unnecessary (see also FIGS. 10A and 10B, which respectively depict device connectors 40 with different number of device contacts 42).

Referring now to FIGS. 11-14, in one embodiment, the device connector 40 has a device mating surface 104 with a cup protrusion 106 extending therefrom. A device recess 108 is defined in the cup protrusion 106 and accommodates the device contacts 42 therein. Similarly, the headpiece connector 34 has a headpiece mating surface 110 with a cup recess 112 defined therein. The cup recess 112 of the headpiece connector 34 is shaped so as to correspond to the cup protrusion 106 of the device connector 40, and includes a headpiece block 114 supported in the cup recess 112 and accommodating the headpiece contacts 36 therein. When in the secured configuration 44, the headpiece mating surface 110 and the device mating surface 104 at least partially abut. It will be appreciated that one or more of the contacts 36, 42 could be spring-loaded so as to promote electrical connection across the power interface 82 and/or the signal interface 84 in the secured configuration 44.

As noted above, the physical interface 86 of the device connector 40 is employed to releasably attach the peripheral device 38 to the headpiece 26, and may be further employed to effect proper alignment between the connectors 34, 40 so as to correspondingly ensure proper function of the power interface 82 and/or the signal interface 84. To that end, in one embodiment, the device recess 108 of the device connector 40 includes a keyway 116, and the headpiece block 114 of the headpiece connector 34 includes a key 118 for engaging in the keyway 116 in the secured configuration 44 so as to effect alignment of the connectors 34, 40 as the peripheral device 38 is secured to the headpiece 26. It will be appreciated that the arrangement of the key 118 and the keyway 116 could be effected in a number of different ways and by any suitable component or structural feature of either connector 34, 40. Moreover, the specific configuration of connectors 34, 40 described above could be re-arranged or otherwise configured in any suitable way sufficient to releasably attach the peripheral device 38 to the headpiece 26, as described above.

In the representative embodiments illustrated herein, the key 118 and the keyway 116, or other suitable complimentarily shaped structure, are arranged so as to at least partially support the peripheral device 38 by the headpiece 26 in the secured configuration 44 so as to inhibit transverse disengagement between the headpiece connector 34 and the device connector 40. Furthermore, the physical interface 84 may include other features so as to secure the peripheral device 38 to the headpiece 26 and to inhibit transverse disengagement between the headpiece connector 34 and the device connector 40.

Advantageously, and according to one embodiment, the headpiece connector 34 includes a first magnetic element 120 and the device connector 40 includes a second magnetic element 122. The first and second magnetic elements 120, 122 are arranged such that magnetic attraction therebetween maintains abutment between the headpiece contact 36 and the device contact 42 in the secured configuration 44. It will be appreciated that this configuration of the physical interface 86 promotes proper alignment and functionality of the power interface 82 and/or the signal interface 84. However, those having ordinary skill in the art will appreciate that the physical interface 86 could be configured in any suitable way sufficient to releasably attach the peripheral device 38 to the headpiece 26, as noted above.

In one embodiment, the first and second magnetic elements 120, 122 have opposing magnetic polarity. In another embodiment, the headpiece connector 34 further includes a third magnetic element 124 and the device connector 40 further includes a fourth magnetic element 126. Here too, the third and fourth magnetic elements 124, 126 are arranged such that magnetic attraction therebetween maintains abutment between the headpiece contact 36 and the device contact 42 in the secured configuration 44. In one embodiment, the third and fourth magnetic elements 124, 126 have opposing magnetic polarity. Similarly, in one embodiment the first and third magnetic elements 120, 124 have opposing magnetic polarity. It will be appreciated that this configuration of the physical interface 86 prevents improper alignment of the contacts 34, 40 in the secured configuration 44, which, by way of non-limiting example, may be particularly advantageous where the common pattern 102 described above is symmetrical and the keyway 116 and/or the key 118 are omitted from the physical interface 86.

As noted above, a number of different components or structural features could be employed by the physical interface 84 so as to secure the peripheral device 38 to the headpiece 26 and to inhibit transverse disengagement between the headpiece connector 34 and the device connector 40. To this end, and as is depicted with dash-dot-dash phantom lines in FIGS. 13 and 14, head unit system 24 could employ a lock mechanism, generally indicated at 128, configured to prevent inadvertent disengagement between the headpiece connector 34 and the device connector 40. As is described in greater detail below, the lock mechanism 128 necessitates predetermined unidirectional removal of the device connector 40 with respect to the headpiece connector 34 in a way that would otherwise not typically be experienced during normal use. By way of non-limiting example, transverse force applied to the peripheral device 38 caused by inadvertent contact with a foreign object would be insufficient to detach the secured peripheral device 38 from the headpiece connector 34, and only force applied in a predetermined direction, such as force applied to the lock mechanism 128, would be sufficient to facilitate detaching the secured peripheral device.

Figure 13:
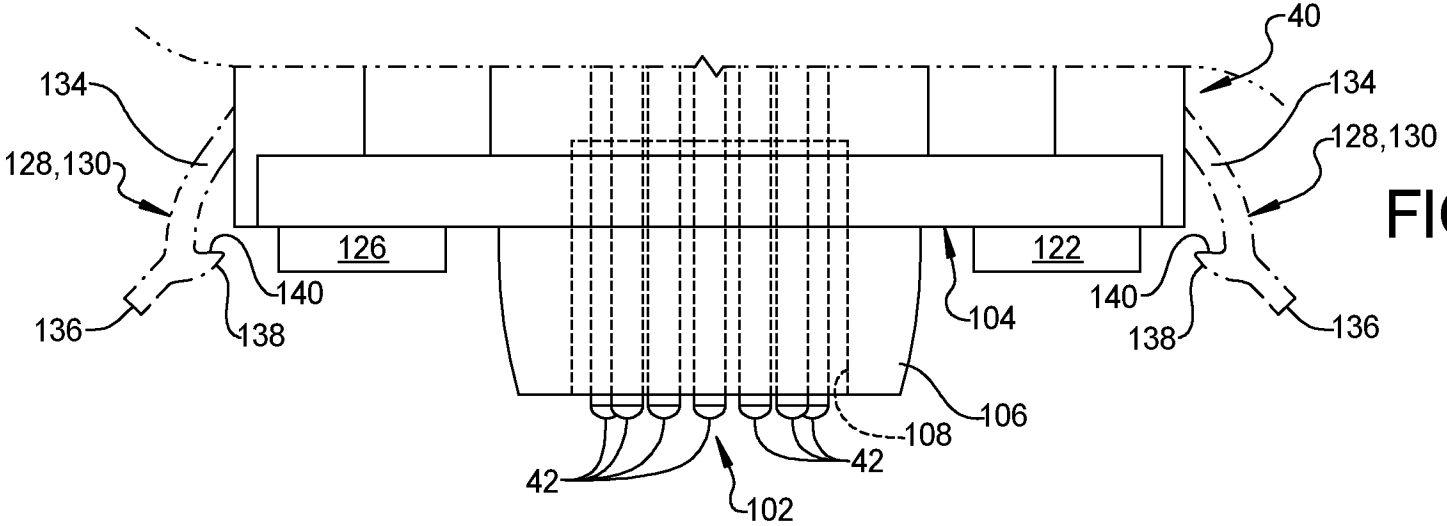
FIG. 13 is a partial top-side plan view of the device connector of FIG. 11 shown with additional detail in dash-dash phantom lines, and depicting a pair of first lock elements in dash-dot-dash phantom lines according to one embodiment.
Figure 14:
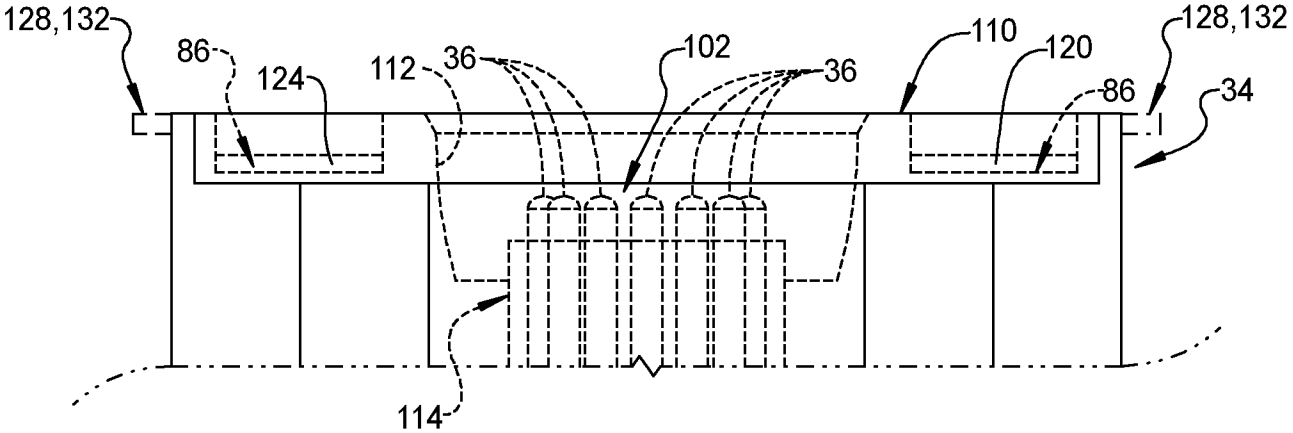
FIG. 14 is a partial top-side plan view of the headpiece connector of FIG. 12 shown with additional detail in dash-dash phantom lines, and depicting a pair of second lock elements in dash-dot-dash phantom lines according to one embodiment.

In the representative embodiment illustrated in phantom in FIGS. 13 and 14, the lock mechanism 128 comprises a first lock element 130 and a second lock element 132. The second lock element 132 is arranged to engage the first lock element 130 to lock the peripheral device 38 to the headpiece 26 in the secured configuration 44 to prevent disengagement between the headpiece connector 34 and the device connector 40. To this end, in one embodiment, a pair of first lock elements 130 are formed integrally with the device connector 40 (see FIG. 13) and a corresponding pair of second lock element 132 are formed integrally with the headpiece connector 34 (see FIG. 14). However, those having ordinary skill in the art will appreciate that any suitable number of lock elements 130, 132 of any suitable type, configuration, or arrangement could be provided on either connector 34, 40.

In the representative embodiment illustrated herein, the second lock elements 132 are realized as protrusions, and the first lock elements 130 each have a resilient cantilevered body 134 extending from the device connector 40 to a release end 136, with a cam surface 138 adjacent to an engagement surface 140 arranged between the device connector 40 and the release end 136. In use, when the device connector 40 is being attached to the headpiece connector 34, the cam surfaces 138 of the first lock elements 130 come into contact with the second lock elements 132 so as to urge the respective cantilevered bodies 134 away from each other until the secured configuration 44 is reached and the cantilevered bodies 134 subsequently move back towards each other as the engagement surfaces 140 come into abutment with the second lock elements 132 to lock the connectors 34, 40 together. In order to remove the device connector 40 from the headpiece connector 34, force may be applied to the release ends 136 until the engagement surface 140 each respectively come out of abutment with the second lock elements 132 at which point the device connector 40 can be detached from the headpiece connector 34.

As noted above, the peripheral device module 66 of the peripheral device 38 can be configured in a number of different ways depending on the application. In the embodiment of the peripheral device 38 illustrated in FIGS. 2-6 and 8, the peripheral device module 66 includes a light source, generally indicated at 70 as noted above, that is configured to provide a source of illumination. The light source 70 peripheral device module 66 is powered when in the secured configuration 44 via the electrical connection with the headpiece 26 across the power interface 82 and/or the signal interface 84, as noted above and as described in greater detail below. In one embodiment, the light source 70 advantageously employs at least one light-emitting diode (LED) to provide a source of illumination for the user 20. It will be appreciated that the illumination afforded by the light source 70 peripheral device module 66 enhances visual observation for the user 20 when the head unit system 24 is being used.

Figure 18:
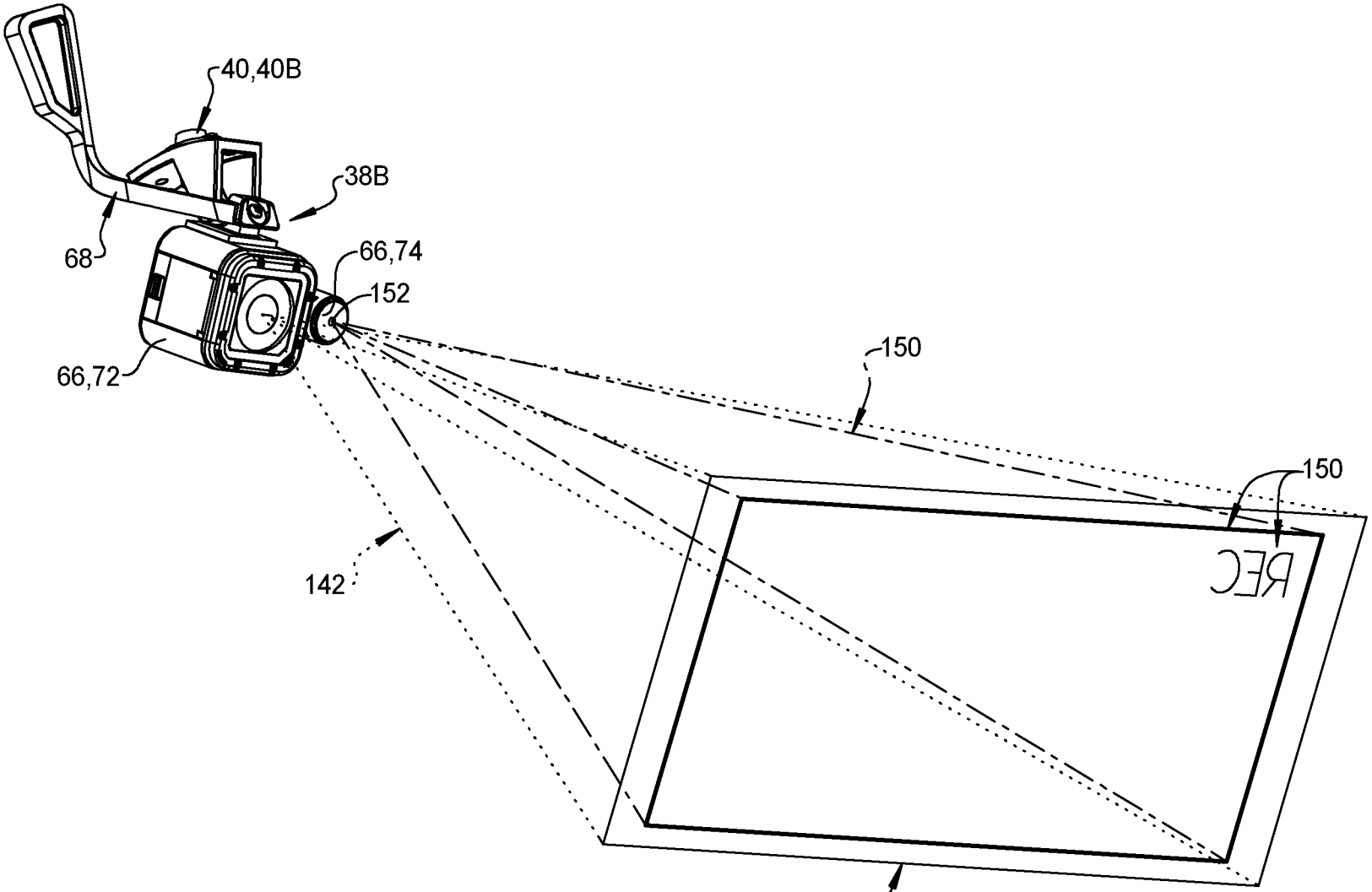
FIG. 18 is a perspective view of the peripheral device of FIG. 7 showing a camera and a projection module emitting a pattern of light in a field of view of the camera.
Figure 19:
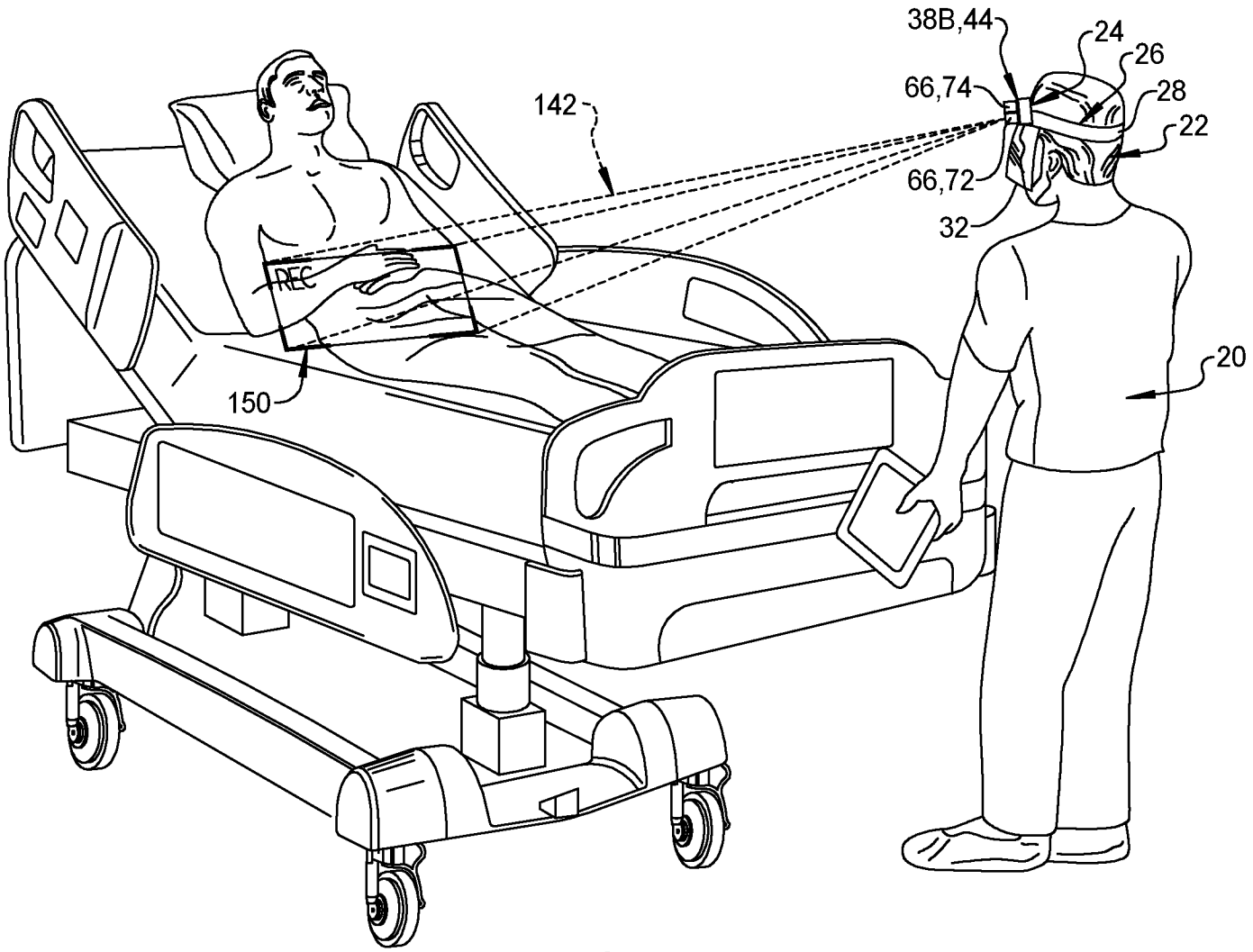
FIG. 19 is a perspective view of the peripheral device of FIG. 7 shown secured to a headpiece worn over a head of a user according to one embodiment.

In the embodiment illustrated in FIGS. 7, 18, and 19, the peripheral device module 66 includes at least one camera, generally indicated at 72 as noted above, that is configured to capture one or more images in a field of view 142 adjacent to the head 22 of the user 20 (see FIGS. 18 and 19). Here, the camera 72 is powered in the secured configuration 44 via the electrical connection with the headpiece 26 across the power interface 82, as noted above. In one embodiment, the camera 72 cooperates with the controller 94 so as to transmit images in the secured configuration 44 via the electrical connection with the headpiece 26 across the signal interface 84, as noted above. More specifically, and as is shown in FIGS. 15A and 15B, the controller 94 is disposed in electrical communication with the headpiece connectors 34 and is configured to communicate with the headpiece 26 and a remote module, generally indicated at 144. Here, communication across the signal interface 84 could be realized by images and/or video IM captured by the camera 72, as noted above. In addition, it will be appreciated that data DA communicated with the remote module 144 could also at least partially represent an operating condition of the headpiece 26 and/or the secured peripheral device 38, such as may be utilized for operating room monitoring systems. In one embodiment, communication between the controller 94 and the remote module 144 is effected across a wireless network 146, such as a WiFi™ network, Bluetooth®, radio network, or any other suitable type of network. To this end, in one embodiment, the headpiece 26 includes a transceiver 148 disposed in electrical communication with the controller 94. Here, the transceiver 148 is configured to communicate with the remote module 144 across the wireless network 146 (see FIGS. 15A and 15B). The transceiver 148 may also be configured to communicate with other devices across the wireless network 146, such as with Radio-Frequency Identification tags, systems, and the like.

With continued reference to FIGS. 7, 18, and 19, in one embodiment, at least one projection module, generally indicated at 74 as noted above, is provided arranged with respect to the camera 72. The projection module 74 is configured to emit a predetermined pattern of light 150 at least partially within the field of view 142 of the camera 72. However, it will be appreciated that the pattern of light 150 could be projected outside of the field of view 142 such that the camera 72 does not capture images of the pattern of light 150 during use. In the representative embodiment illustrated herein, the camera 72 and the projection module 74 are formed as a single peripheral device module 66 so as to afford optimization of alignment between the field of view 142 of the camera 72 and the pattern of light 150 emitted by the projection module 74. Here, the camera 72 and the projection module 74 are formed integrally, but could alternatively be operatively attached to each other in any suitable way. Similarly, it is also conceivable that the projection module 74 could be formed separately as a different peripheral device module 66 of a different peripheral device 38 and could cooperate with the camera 72 to effect projection of the pattern of light 150.

The projection module 74 employs a projection source, generally indicated at 152, configured to emit the predetermined pattern of light 150. It will be appreciated that the projection source 152 could be of any suitable type capable of emitting visible light with a wavelength of approximately 390-700 nm. By way of non-limiting example, the projection source 152 could be realized as a light-emitting diode (LED) or a laser diode that employs one or more standard components, such as mirrors and/or lenses which cooperate to effect projection of the pattern of light 150 onto objects in the field of view 142 of the camera 72.

As shown in FIG. 19, in one embodiment, the pattern of light 150 emitted by the projection module 74 is realized by four generally L-shaped segments of light that bracket the field of view 142 of the camera 72. The projection module 74 may be configured to be in electrical communication with the camera 72 such that the pattern of light 150 is emitted when the camera 72 is recording images. However, it will be appreciated that the projection module 74 could emit the predetermined pattern of light 150 independent of the operation of the camera 72. Further, the pattern of light 150 could be emitted in different ways depending on the operational status of the camera 72. By way of non-limiting example, the pattern of light 150 could change to a different pattern, color, or orientation, and/or could display indicative text (such as "REC") when the camera 72 is capturing images and/or video. Moreover, while the pattern of light 150 shown in FIG. 19 is projected entirely onto objects within the field of view 142 of the camera 72, it will be appreciated that the projection module 74 could emit one or more portions of the pattern of light 150 on the face shield 32 of the headpiece 26. Similarly, one or more visual indicia could be printed on the face shield 32 of the headpiece 26 in a predetermined location, such as by brackets representing the field of view 142 of the camera 72 when viewed by the user 20.

Referring again to FIGS. 15A and 15B, the peripheral device module 66 may include a microphone, generally indicated at 76 as noted above, and/or a speaker, generally indicated at 78 as noted above, for facilitating communication with the user 20. Here, the microphone 76 and/or speaker 78 may be powered in the secured configuration 44 via the power interface 82, and may be configured to transmit and/or receive audio data DA across the signal interface 84 in the secured configuration 44, such as by cooperating with the controller 94 to communicate across the network 146 as described above.

In one embodiment, the peripheral device module 66 may include a visual display module, generally indicated at 116 as noted above, that is configured to display predetermined data adjacent to the head 22 of the user 20, such as via data DA or communication CM transmitted across the signal interface 84. By way of non-limiting example, the visual display module 80 could be realized as one or more status indicating lights and/or a display panel so as to serve as a so-called "heads-up display".

In one embodiment, the headpiece 26 includes an input control 154 configured so as to facilitate selective control of one or more secured peripheral devices 38. As shown schematically in FIGS. 15A and 15B, the input control 154 is disposed in electrical communication with the controller 94 and allows the user to manually adjust or otherwise control secured peripheral devices 38 and/or the air distribution system 60. It will be appreciated that the controller 94 could respond to predetermined changes in the input control 154 so as to correspondingly effect changes to one or more secured peripheral devices 38 across the signal interface 84. By way of non-limiting example, the input control 154 could include a rotary potentiometer employed to at least partially change the brightness of light emitted by the light source 70 peripheral device module 66. Similarly, the input control 154 could include one or more buttons employed to start and/or stop recording video with the camera 72 peripheral device module 66. It will be appreciated that the input control 154 could be realized in a number of different ways and, thus, could be configured to communicate with or otherwise control any number of secured peripheral devices 38 in any suitable way sufficient to effect user-manipulated adjustability and/or control. For instance, the input control 154 could also be implemented as inputs on a touch screen, physical buttons that activate switches, voice activation, gesture inputs, and the like.

In this way, the head unit system 24 provides significantly increased modular attachment of peripheral devices 38 to headpieces 26 configured to provide a personal protective barrier to the user 20 while, at the same time, facilitating electrical communication between the peripheral device 38 and headpiece 26. In particular, the head unit system 24 enables the user 22 to selectively interchange and re-position different types of peripheral devices 38 equipped with different peripheral device modules 66 to accommodate respectively different applications with a single headpiece 26. By way of example, the user 20 can secure a peripheral device 38 with a light source 70 peripheral device module 66 for use during certain medical practices and procedures, and can remove and/or exchange it for a peripheral device 38 with a different peripheral device module 66 during other medical practices and procedures. Moreover, it will be appreciated that the arrangement of multiple headpiece connectors 34 affords significant opportunities for securing and powering and/or communicating with a variety of different peripheral devices 38 in a simple and cost-effect manner while, at the same time, reducing the cost and complexity of manufacturing, assembling, and using lightweight head unit systems 24 that provide users with improved features, functionality, and usability.

It will be further appreciated that the terms "include," "includes," and "including" have the same meaning as the terms "comprise," "comprises," and "comprising." Moreover, it will be appreciated that terms such as "first," "second," "third," and the like are used herein to differentiate certain structural features and components for the non-limiting, illustrative purposes of clarity and consistency.

Several embodiments have been discussed in the foregoing description. However, the embodiments discussed herein are not intended to be exhaustive or limit the invention to any particular form. The terminology which has been used is intended to be in the nature of words of description rather than of limitation. Many modifications and variations are possible in light of the above teachings and the invention may be practiced otherwise than as specifically described.

Embodiments of the disclosure can be described with reference to the following numbered clauses, with specific features laid out in the dependent clauses:

I. A head unit system for a head of a user, said head unit system comprising:

a headpiece for being worn over the head of the user, said headpiece including: a support structure shaped to be worn over the head of the user, a shield mount operatively attached to said support structure and arranged for supporting a transparent face shield adjacent to the head of the user, and a headpiece connector operatively attached to said support structure and having at least one headpiece contact configured for electrical connection; and a peripheral device for being secured to said headpiece for concurrent movement therewith, said peripheral device having a device connector with at least one device contact configured for electrical connection;

wherein said device connector and said headpiece connector cooperate to releasably attach said peripheral device to said headpiece in a secured configuration with said headpiece contact and said device contact abutting in said secured configuration so as to facilitate electrical connection between said headpiece and said secured peripheral device.

II. The head unit system as set forth in clause I, wherein said headpiece further includes an interface connector operatively attached to said support structure, disposed in electrical communication with said headpiece connector, and configured to communicate at least one of electrical power and electrical signals with said secured peripheral device.

III. The head unit system as set forth in clause II, further including a battery module for providing a source of electrical power to said secured peripheral device, said battery module having a tether connector configured for removable attachment to said interface connector of said headpiece.

IV. The head unit system as set forth in clause II, wherein said headpiece further includes an air distribution system operatively attached to said support structure for distributing air about the head of the user.

V The head unit system as set forth in clause IV, wherein said air distribution system includes a fan module disposed in electrical communication with said interface connector.

VI. The head unit system as set forth in any preceding clause, wherein said at least one headpiece contact is further defined as a plurality of headpiece contacts arranged such that at least one of said plurality of headpiece contacts abuts said device contact of said device connector in said secured configuration.

VII. The head unit system as set forth in clause VI, wherein said at least one device contact is further defined as a plurality of device contacts arranged such that each of said device contacts abuts one of said plurality of headpiece contacts of said headpiece connector in said secured configuration.

VIII. The head unit system as set forth in any preceding clause, including a second headpiece connector operatively attached to said support structure, with each of said headpiece connectors defining a predetermined mounting position of said headpiece for selectively and interchangeably securing said peripheral device in one of said mounting positions.

IX. The head unit system as set forth in clause VIII, wherein said headpiece connectors are spaced from each other about said support structure.

X. The head unit system as set forth in clause VIII, wherein said headpiece connectors are electrically connected to each other along at least one common electrical path.

XI. The head unit system as set forth in clause VIII, wherein said at least one headpiece contact is further defined as a first plurality of headpiece contacts and wherein said second headpiece connector has a second plurality of headpiece contacts, with said first plurality of headpiece contacts being arranged in a common pattern with said second plurality of headpiece contacts.

XII. The head unit system as set forth in clause XI, wherein said headpiece contacts of each headpiece connector are respectively electrically connected to each other based on respective arrangement in said common pattern.

XIII The head unit system as set forth in clause XI, wherein said headpiece contacts in each headpiece connector are arranged correspondingly in said common pattern such that at least one of said headpiece contacts abuts said device contact of said device connector in said secured configuration.

XIV. The head unit system as set forth in clause VIII, including a plurality of peripheral devices for being secured to different predetermined mounting positions of said headpiece.

XV. The head unit system as set forth in any preceding clause, wherein said peripheral device includes at least one peripheral device module in electrical communication with said device connector and supported for concurrent movement therewith.

XVI. The head unit system as set forth in clause XV, wherein said peripheral device further includes an adjustment linkage interposed between said peripheral device module and said device connector for selectively adjusting a relative position of said peripheral device module with respect to said device connector.

XVII. The head unit system as set forth in clause XV, wherein said peripheral device module includes a light source configured to provide a source of illumination, said light source being powered in said secured configuration via said electrical connection with said headpiece.

XVII. The head unit system as set forth in clause XVII, wherein said light source includes at least one light emitting diode.

XIX. The head unit system as set forth in clause XV, wherein said peripheral device module includes at least one camera configured to capture one or more images in a field of view adjacent to the head of the user.

XX. The head unit system as set forth in clause XIX, wherein said camera is powered in said secured configuration via said electrical connection with said headpiece.

XXI. The head unit system as set forth in clause XIX, wherein said camera transmits images in said secured configuration via said electrical connection with said headpiece.

XXII. The head unit system as set forth in clause XIX, wherein said peripheral device module includes at least one projection module arranged with respect to said camera and configured to emit a predetermined pattern of light at least partially within said field of view of said camera.

XXIII. The head unit system as set forth in clause XXII, wherein said projection module includes at least one laser diode configured to selectively emit said predetermined pattern of light.

XXIV. The head unit system as set forth in clause XV, wherein said peripheral device module includes at least one of a microphone and a speaker for facilitating communication with the user.

XXV. The head unit system as set forth in clause XXIV, wherein at least one of said microphone and said speaker is powered in said secured configuration via said electrical connection with said headpiece.

XXVI. The head unit system as set forth in clause XXIV, wherein at least one of said microphone and said speaker transmits audio in said secured configuration via said electrical connection with said headpiece.

XXVII. The head unit system as set forth in clause XV, wherein said peripheral device module includes at least one visual display module configured to display predetermined data adjacent to the head of the user.

XXVIII. The head unit system as set forth in any preceding clause, wherein one of said headpiece connector and said device connector includes a key, the other of said headpiece connector and said device connector includes a keyway, and wherein said key and said keyway cooperate so as to effect alignment of said connectors as said peripheral device is secured to said headpiece.

XXIX. The head unit system as set forth in any preceding clause, wherein said key and said keyway are arranged so as to at least partially support said peripheral device with respect to said headpiece in said secured configuration.

XXX. The head unit system as set forth in any preceding clause, wherein said headpiece connector includes a first magnetic element, said device connector includes a second magnetic element, and wherein magnetic attraction between said first and second magnetic elements maintains abutment between said headpiece contact and said device contact in said secured configuration.

XXXI. The head unit system as set forth in clause XXX, wherein said first and second magnetic elements have opposing polarity.

XXXII. The head unit system as set forth in clause XXX, wherein said headpiece connector further includes a third magnetic element, said device connector further includes a fourth magnetic element, and wherein magnetic attraction between said third and fourth magnetic elements maintains abutment between said headpiece contact and said device contact in said secured configuration.

XXXIII. The head unit system as set forth in clause XXXII, wherein said first and third magnetic elements have opposing polarity.

XXXIV. The head unit system as set forth in any preceding clause, wherein said headpiece further includes a controller operatively attached to said support structure, disposed in electrical communication with said headpiece connector, and configured to communicate data between said headpiece and a remote module.

XXXV. The head unit system as set forth in clause XXXIV, wherein said data communicated with said remote module at least partially represents an operating condition of said secured peripheral device.

XXXVI. The head unit system as set forth in clause XXXIV, wherein said controller communicates with said remote module across a wireless network.

XXXVII. The head unit system as set forth in any preceding clause, wherein said headpiece further includes a controller operatively attached to said support structure, disposed in electrical communication with said headpiece connector, and configured to communicate data with said headpiece representing an identification of said secured peripheral device.

XXXVIII. The head unit system as set forth in clause XXXVII, wherein said controller is configured to authenticate said secured peripheral device based on predetermined identification data of said secured peripheral device corresponding to predetermined identification data of said controller, and wherein said controller is further configured to interrupt electrical communication with said secured peripheral device in response to predetermined differences occurring between said predetermined identification data.

XXXIX. The head unit system as set forth in clause XXXVII, wherein said predetermined identification data communicated between said controller and said peripheral device to authenticate said peripheral device are further defined as Radio-Frequency Identification data.

XL. The head unit system as set forth in any preceding clause, wherein one of said headpiece connector and said device connector includes a first lock element, and the other of said headpiece connector and said device connector includes a second lock element arranged to engage said first lock element to lock said peripheral device to said headpiece in said secured configuration to prevent disengagement between said headpiece connector and said device connector.

XLI. The head unit system as set forth in any preceding clause, wherein one of said headpiece connector and said device connector includes a key and the other of said headpiece connector and said device connector includes a keyway, wherein said key and said keyway cooperate to align said connectors as said peripheral device is secured to said headpiece, and wherein said key and said keyway are arranged to at least partially support said peripheral device with respect to said headpiece in said secured configuration so as to inhibit transverse disengagement between said headpiece connector and said device connector.

XLII. A headpiece for use with the head unit system as set forth in any preceding clause.

XLIII. A peripheral device for use with the head unit system as set forth in any preceding clause.

The invention claimed is:

1. A head unit system for use with a surgical gown to be worn over a head of a user, said head unit system comprising:

a headpiece for being worn over the head of the user;

a support structure shaped to be worn over the head of the user, said support structure positioned below the headpiece and having a front support section and a rear support section;

an air distribution system operatively disposed in the headpiece, said air distribution system having a fan module for distributing air about the head of the user;

a facial section arranged to be positioned forward of the head of the user;

at least one shield mount operatively attached to each of said front support section of said support structure and said facial section, and arranged for supporting a face shield of the surgical gown adjacent to the head of the user; and a headpiece connector operatively coupled to said front support section of said support structure, said headpiece connector comprising a headpiece contact configured for electrical connection;

a first peripheral device for being secured to said headpiece for concurrent movement therewith, said first peripheral device having a first device connector with a first device contact configured for electrical connection with said headpiece contact; and a second peripheral device, different from said first peripheral device, for being secured to said headpiece for concurrent movement therewith, said second peripheral device having a second device connector with a second device contact configured for electrical connection with said headpiece contact;

wherein one of said first device connector or said second device connector are configured to cooperate with said headpiece connector to releasably attach one of said first peripheral device or said second peripheral device to said front support section of said support structure in a secured configuration with said headpiece contact and one of said first device contact or said second device contact facilitate electrical connection between said headpiece connector and one of said first device connector or said second device connector when said respective peripheral device is secured to said front support section of said support structure.

2. The head unit system as set forth in claim 1, wherein said headpiece contact is further defined as a plurality of headpiece contacts arranged such that at least one of said plurality of headpiece contacts abuts said first device contact of said first device connector when said first peripheral device is secured to said front support section of said support structure.

3. The head unit system as set forth in claim 1, further including a second headpiece connector operatively attached to one of said front support section of said support structure or said shield mount, with each of said first and second headpiece connectors defining a predetermined mounting position on said front support section for selectively and interchangeably securing one of said first or second peripheral devices in one of said mounting positions.

4. The head unit system as set forth in claim 1, wherein said first peripheral device includes a first peripheral device module in electrical communication with said first device connector and supported for concurrent movement therewith.

5. The head unit system as set forth in claim 4, wherein said first peripheral device module includes a light source configured to provide a source of illumination, said light source being powered in said secured configuration via said electrical connection with said headpiece.

6. The head unit system as set forth in claim 4, wherein said first peripheral device module includes a camera configured to capture images in a field of view adjacent to the head of the user.

7. The head unit system as set forth in claim 4, wherein said first peripheral device module includes at least one of a microphone or a speaker for facilitating communication with the user.

8. The head unit system as set forth in claim 1, wherein one of said headpiece connector or said first device connector includes a key and the other of said headpiece connector and said first device connector includes a keyway, wherein said key and said keyway cooperate to align said connectors as said first peripheral device is secured to said headpiece, and wherein said key and said keyway are arranged to at least partially support said first peripheral device with respect to said headpiece in said secured configuration so as to inhibit transverse disengagement between said headpiece connector and said first device connector.

9. The head unit system as set forth in claim 1, wherein said headpiece connector includes a first magnetic element, and said first device connector includes a second magnetic element; and wherein magnetic attraction between said first and second magnetic elements maintains abutment between said headpiece contact and said first device contact of said first device connector in said secured configuration.

10. The head unit system as set forth in claim 1, wherein said headpiece further includes a controller operatively attached to said support structure, disposed in electrical communication with said headpiece connector, and configured to communicate data between said headpiece and a remote module.

11. The head unit system as set forth in claim 10, wherein said data communicated with said remote module includes an operating condition of said first peripheral device.

12. The head unit system as set forth in claim 10, wherein said headpiece further includes a transceiver disposed in electrical communication with said controller and configured to communicate with said remote module across a wireless network.

13. The head unit system as set forth in claim 1, wherein one of said headpiece connector or said first device connector includes a first lock element, and the other of said headpiece connector and said first device connector includes a second lock element arranged to engage said first lock element to lock said first peripheral device to said headpiece in said secured configuration to prevent disengagement between said headpiece connector and said first device connector.

14. The head unit system as set forth in claim 1, further comprising a surgical gown including a face shield removably secured to said support structure by said at least one shield mounts, said surgical gown disposed over the headpiece to provide a protective barrier for the user.

15. The head unit system as set forth in claim 1, wherein said facial section is operatively attached to said front support section of said support structure.

16. A head unit system for use with a surgical gown to be worn over a head of a user, said head unit system comprising:

a headpiece for being worn over the head of the user;

a support structure shaped to be worn over the head of the user, said support structure positioned below the headpiece and having a front support section and a rear support section;

an air distribution system operatively disposed in the headpiece, said air distribution system having a fan module for distributing air about the head of the user;

a facial section arranged to be positioned forward of the head of the user;

at least one shield mount operatively attached to each of said front support section of said support structure and said facial section, and arranged for supporting a face shield of the surgical gown adjacent to the head of the user;

a headpiece connector operatively coupled to said front support section of said support structure, said headpiece connector comprising a headpiece contact configured for electrical connection;

a first peripheral device for being secured to said headpiece for concurrent movement therewith, said first peripheral device having a first device connector with a first device contact configured for electrical connection with said headpiece contact on said front support section, wherein said first peripheral device comprises a light source; and a second peripheral device for being secured to said headpiece for concurrent movement therewith, said second peripheral device having a second device connector with a second device contact configured for electrical connection with said headpiece contact on said front support section, said second peripheral device comprises a camera;

wherein one of said first device connector or said second device connector are configured to cooperate with said headpiece connector to releasably attach one of said first peripheral device or said second peripheral device to said front support section in a secured configuration with said headpiece contact and one of said first device contact or said second device contact abutting in said secured configuration so as to facilitate electrical connection between said headpiece connector and one of said first device connector or said second device connector when said respective peripheral device is secured to said front support section.

17. The head unit system as set forth in claim 16, wherein one of said headpiece connector or said first device connector includes a key and the other of said headpiece connector and said first device connector includes a keyway, wherein said key and said keyway cooperate to align said connectors as said first peripheral device is secured to said front support section, and wherein said key and said keyway are arranged to at least partially support said first peripheral device with respect to said front support section in said secured configuration so as to inhibit transverse disengagement between said headpiece connector and said first device connector.

18. The head unit system as set forth in claim 16, wherein said headpiece connector includes a first magnetic element, and said first device connector includes a second magnetic element; and wherein magnetic attraction between said first and second magnetic elements maintains abutment between said headpiece contact and said first device contact of said first device connector in said secured configuration.

19. The head unit system as set forth in claim 16, wherein said headpiece further includes a controller operatively attached to said support structure, disposed in electrical communication with said headpiece connector, and configured to communicate data between said headpiece and a remote module.

20. A head unit system for use with a surgical gown to be worn over a head of a user, said head unit system comprising:

a headpiece for being worn over the head of the user;

a support structure shaped to be worn over the head of the user, said support structure positioned below the headpiece and having a front support section and a rear support section;

a shield mount operatively attached to said front support section of said support structure and arranged for supporting a face shield of the surgical gown adjacent to the head of the user; and a headpiece connector operatively coupled to said front support section of said support structure, said headpiece connector comprising a headpiece contact configured for electrical connection;

an air distribution system operatively disposed within said headpiece and above said support structure, said air distribution system having a fan module for distributing air about the head of the user;

a first peripheral device for being secured to said front support section of said support structure for concurrent movement therewith, said first peripheral device having a first device connector with a first device contact configured for electrical connection; and a second peripheral device for being secured to said front support section of said support structure for concurrent movement therewith, said second peripheral device having a second device connector with a second device contact configured for electrical connection;

wherein one of said first device connector or said second device connector are configured to cooperate with said headpiece connector on said front support section of said support structure to releasably attach one of said first peripheral device or said second peripheral device to said front support section in a secured configuration with said headpiece contact and one of said first device contact or said second device contact abutting in said secured configuration so as to facilitate electrical connection between said headpiece connector and one of said first device connector or said second device connector when said respective peripheral device is secured to said front support section of said support structure, wherein said headpiece connector includes a first magnetic element, and said first device connector includes a second magnetic element; and wherein magnetic attraction between said first and second magnetic elements maintains abutment between said headpiece contact and said first device contact of said first device connector in said secured configuration.

* * * * *